US010052009B1

(12) United States Patent
Morad

(10) Patent No.: US 10,052,009 B1
(45) Date of Patent: Aug. 21, 2018

(54) APPARATUS TO REMOVE A DISPOSABLE CLOTH FROM A HAND OPERATED FLAT MOP WITHOUT HAVING TO TOUCH THE CLOTH COMBINED WITH A YOKE AFFIXED TO THE TOP OF THE FLAT MOP AND A PIN OR DOWEL ADJACENT THE BOTTOM OF THE MOP HANDLE ROTATABLY RETAINED IN THE YOKE

(71) Applicant: Fred I. Morad, Toluca, CA (US)

(72) Inventor: Fred I. Morad, Toluca, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 15/680,983

(22) Filed: Aug. 18, 2017

Related U.S. Application Data

(60) Provisional application No. 62/412,776, filed on Oct. 25, 2016.

(51) Int. Cl.
*A47L 13/256* (2006.01)
*A47L 13/44* (2006.01)
*A47L 13/254* (2006.01)

(52) U.S. Cl.
CPC ..... *A47L 13/256* (2013.01); *A47L 13/254* (2013.01); *A47L 13/44* (2013.01)

(58) Field of Classification Search
CPC ..... A47L 13/254; A47L 13/256
USPC ..... 15/147.1, 147.2, 151, 228, 231
See application file for complete search history.

(56) References Cited

U.S. PATENT DOCUMENTS

| | | | | |
|---|---|---|---|---|
| 8,677,547 | B1 * | 3/2014 | Morad | H04L 51/32 15/147.1 |
| 8,701,238 | B1 * | 4/2014 | Morad | A47L 13/254 15/147.1 |
| 8,800,092 | B1 | 8/2014 | Morad | |
| 9,072,419 | B1 * | 7/2015 | Morad | A47L 13/256 |
| 2011/0023251 | A1 * | 2/2011 | Bober | A47L 13/256 15/228 |
| 2015/0208893 | A1 | 7/2015 | Stephens et al. | |

* cited by examiner

*Primary Examiner* — Mark Spisich
(74) *Attorney, Agent, or Firm* — Thomas I. Rozsa

(57) ABSTRACT

A dual trigger member to release a disposable microfiber cloth or non-woven cloth from a flat mop combined with a yoke and a rotatable handle affixed to the yoke. The flat mop with yoke and rotatable handle and dual trigger allow a user to easily change a disposable cloth without touching the cloth. Further, the yoke allows the handle to rotate 180 degrees relative to the yoke and the perpendicular direction relative to the mop and allows a user 180 degrees of range of movement of the cleaning tool during use resulting in less energy exerted by the user.

12 Claims, 30 Drawing Sheets

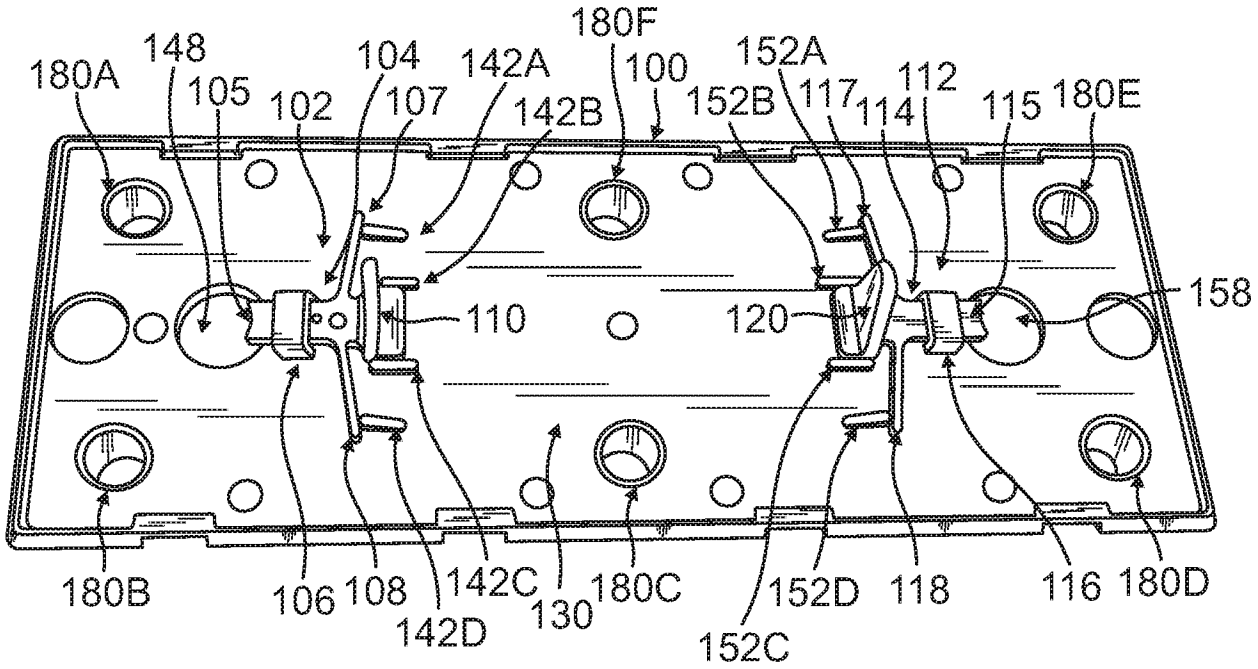
FIG. 4A1

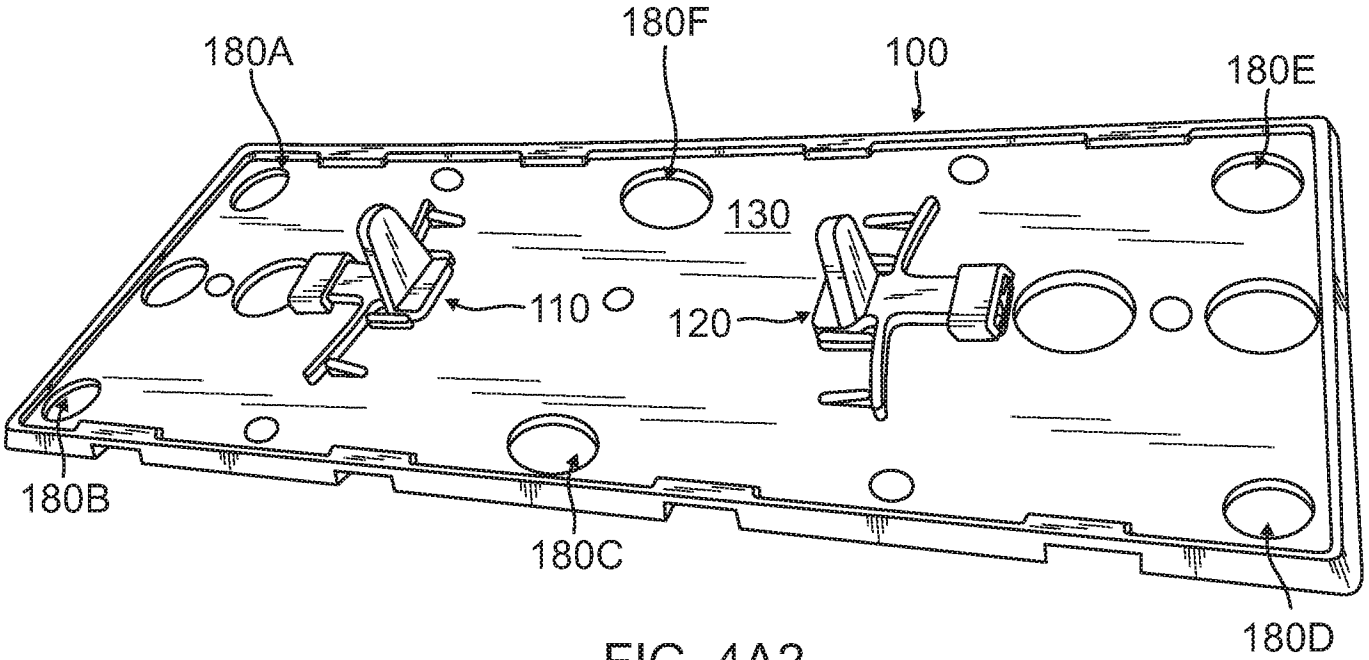
FIG. 4A2

APPARATUS TO REMOVE A DISPOSABLE CLOTH FROM A HAND OPERATED FLAT MOP WITHOUT HAVING TO TOUCH THE CLOTH COMBINED WITH A YOKE AFFIXED TO THE TOP OF THE FLAT MOP AND A PIN OR DOWEL ADJACENT THE BOTTOM OF THE MOP HANDLE ROTATABLY RETAINED IN THE YOKE

CROSS-REFERENCE TO RELATED APPLICATION

This patent application claims priority to Provisional Application Ser. No. 62/412,776 filed on Oct. 25, 2016.

BACKGROUND OF THE INVENTION

1. Field of the Invention

The present invention relates to the field of hand-operated flat mops which retain a disposable cleaning cloth used to scrub and clean surfaces such as floors.

2. Description of the Prior Art

The present inventor Fred I. Morad is a co-inventor of the invention entitled U.S. Pat. No. 8,800,092 for "APPARATUS TO REMOVE A DISPOSABLE CLOTH FROM A HAND OPERATED FLAT MOP THROUGH A SINGLE TRIGGER MECHANISM WITHOUT HAVING TO TOUCH THE DISPOSABLE CLOTH" issued on Aug. 12, 2014.

The present inventor Fred I. Morad is also aware of pending patent application Ser. No. 14/596,325, Publication No. 2015/0208893 filed by Stephens et. al. for "APPARATUS AND METHOD FOR PREPARING A SURFACE" published Jul. 30, 2015.

SUMMARY OF THE INVENTION

The present invention is a dual trigger mechanism to release a disposable microfiber cloth or non-woven cloth from a flat mop combined with a yoke rotatably retaining a handle, the handle rotating at an arc of 180 degrees relative to the yoke. There are five major components in the present invention: (1) a yoke rotatably affixed to a handle, the yoke enabling the handle to rotate 180 degrees; (2) a top plate; (3) a mechanical plate with a dual trigger mechanism incorporated into the mechanical plate; (4) a push plate; and (5) a pad made of material such as foam or rubber below the push plate. In one variation, the invention retains a microfiber cloth or cloth made out of similar material. In an alternative variation, the invention retained a non-woven cloth or cloth made out of similar material.

The top plate is stationary. It has a flat top surface with a yoke at a center of the top plate and rotatably supporting a handle so that the handle can rotate in an arc perpendicular to the yoke.

The top plate also includes spaced apart trigger activation member or squeeze member openings spaced at equidistant opposite sides of the ball and extending through the thickness of the top plate. A first trigger activation member extends through a first activation member opening and a second trigger activation members extends through a second activation member opening. Each trigger activation member extends perpendicular to the upper surface of the top plate. The first and second trigger activation members are parallel to each other. Each respective trigger mechanism opening is sufficiently wide to enable each respective trigger mechanism to be pushed toward the center ball, or alternatively squeezed between two fingers to push each respective trigger activation member toward the ball.

The top plate also includes a first ratchet collar cover located on the same side as and spaced apart from the first trigger activation member opening, and closer to the first end of the top plate. The top plate also includes a second ratchet collar cover located on the same side as and spaced apart from the second trigger activation member opening, and closer to the second end of the top plate. Each respective ratchet collar cover is respectively spaced apart from a respective trigger activation member opening and each is further away from the center ball.

The top plate has a bottom surface which includes a first compression spring housing supporting the top of a first compression spring and a second compression spring housing supporting the top of a second compression spring.

The push plate is designed to facilitate the retention of the microfiber cloth or non-woven cloth and facilitate the removal of a dirty cloth without a user's hand touching the cloth. There are two variations of the push plate. Each variation has the following same components. Affixed to the top surface of the push plate is a first ratchet collar vertically aligned with the first ratchet collar cover of the top plate and spaced apart from the first operating trigger assembly of the first trigger mechanism on the mechanical plate. The first ratchet collar has a sidewall with a first ratchet notch which receives a first notch tooth from the first trigger mechanism. The first ratchet collar extends through aligned openings in the mechanical plate and the top plate and is received in the first ratchet collar cover on the top plate. Similarly, affixed to the top surface of the push plate is a second ratchet collar vertically aligned with the second ratchet collar cover of the top plate and spaced apart from the second operating trigger assembly of the second trigger mechanism on the mechanical plate. The second ratchet collar has a sidewall with a second ratchet notch which receives a second notch tooth from the second trigger mechanism. The second ratchet collar extends through aligned openings in the mechanical plate and the top plate and is received in the second ratchet collar cover on the top plate.

Affixed to the top surface of the push plate and spaced apart from the first ratchet collar is a first bottom compression spring housing retaining the bottom of the first compression spring extending through an aligned first spring opening in the mechanical plate and retained in the vertically aligned first top compression spring housing on the bottom surface of the top plate. Similarly, affixed to the top surface of the push plate and spaced apart from the second ratchet collar is a second bottom compression spring housing retaining the bottom of the second compression spring extending through an aligned second spring opening in the mechanical plate and retained in the vertically aligned second top compression spring housing on the bottom surface of the top plate.

A first mechanical fastening member (such as a fastening pin) has a top end and a bottom end and extends from its bottom end affixed within the push plate and extends through the push plate, through an aligned opening in the mechanical plate and into an aligned opening within the first ratchet collar and having its top end retained within the first ratchet collar.

Similarly, a second mechanical fastening member (such as a fastening pin) has a top end and a bottom end and extends from its bottom end affixed within the push plate and extends through the push plate, through an aligned opening in the mechanical plate and into an aligned opening within the second ratchet collar and having its top end retained within the second ratchet collar.

A first pin retaining member (such as a Tinnerman Clip) retains the first mechanical fastening member at the bottom surface of the push plate and within the first ratchet collar and a second pin retaining member (such as a Tinnerman Clip) retains the second mechanical fastening member at the bottom surface of the push plate and within the second ratchet collar.

The variations on the push plate have the following differences. In a first variation, the push plate facilitates the retention of a microfiber cloth and has a multiplicity of openings to enable microfiber cloth retention members extending from the bottom of the mechanical plate to engage and retain the microfiber cloth. In the present invention, there are six openings, three in one row and three in an opposite parallel row with an opening in one row aligned with an opening in the second row. Six respective aligned posts each having a mating hook fastener at its distal end extend from the bottom surface of the mechanical plate through a respective opening in the push plate to retain the microfiber cloth.

In the first variation of the push plate, a bottom surface has a multiplicity of ribs to facilitate retention of a pad such as a rubber or foam pad with adhesive applied to the ribs) against the bottom surface of the push plate. The rubber or foam pad has a multiplicity of openings respectively aligned with the openings in the push plate to enable the microfiber cloth retention members to extend through the pad and to engage and retain the microfiber cloth.

In the second variation, the top surface of the push plate has a multiplicity of aligned teeth adjacent respective parallel longitudinal sides of the push plate and corresponding with aligned openings in the bottom of the mechanical plate. A non-woven cloth is wrapped around the push plate, partially retained by the aligned parallel rows of teeth and retained by a press fit between the push plate and the mechanical plate.

The last component is the mechanical plate which is stationary and affixed to the bottom of the top plate. A first ratchet collar opening in the mechanical plate enables the first ratchet collar to extend through this aligned opening in the mechanical plate and rest within the first ratchet collar cover and a second ratchet collar opening in the mechanical plate enables the second ratchet collar to extend through this aligned opening in the mechanical plate and rest within the second ratchet collar cover.

A first compression spring opening in the mechanical plate enables the first compression spring to extend from the first bottom compression spring housing on the push plate through the first compression spring opening in the mechanical plate into the first top compression spring housing on the top plate. Similarly, a second compression spring opening in the mechanical plate enables the second compression spring to extend from the second bottom compression spring housing on the push plate through the second compression spring opening in the mechanical plate into the second top compression spring housing on the top plate.

The top surface of the mechanical plate includes a first trigger mechanism having a first "L"-shaped member with an upper portion extending through a first trigger activation mechanism opening in the top to enable the upper portion of the first "L"-shaped member to extend perpendicular to the top plate. The horizontal portion of the first "L"-shaped member extends to engage a first transverse trigger mechanism spring member, is further aligned with a first stop member on the top surface of the mechanical plate and at its end forms a first notch tooth which extends into the first ratchet notch of the first ratchet collar. Similarly, the second trigger mechanism includes a second "L"-shaped member with an upper portion extending through a second trigger activation mechanism opening in the top plate to enable the upper portion of the second "L"-shaped member to extend perpendicular to the top plate. The horizontal portion of the second "L"-shaped member extends to engage a second transverse trigger mechanism spring member, is further aligned with a second stop member on the top surface of the mechanical plate and at its end forms a second notch tooth which extends into the second ratchet notch of the second ratchet collar.

The mechanical plate is retained into or onto the top plate by mating notch and tooth members along the bottom wall of the top plate and along exterior portions of the mechanical plate.

In operation, the first transverse spring member forces the first notch tooth into the first ratchet notch of the first ratchet collar and the second transverse spring member forces the second notch tooth into the second ratchet notch of the second ratchet collar.

A concurrent squeezing force of the upper "L"-shaped members of the first and second trigger activation members forcing the first trigger activation member to move toward the center ball and forcing the second trigger activation member to move toward the center ball, concurrently causing the first ratchet tooth to be removed from the first ratchet notch of the first ratchet collar and the second ratchet tooth to be removed from the second ratchet notch of the second ratchet collar. The force of the first compression spring and the second compression spring forces the push plate to move away from the mechanical plate. The cloth which was retained against the bottom surface of the push plate by either being retained by the hook fasteners for a microfiber cloth or retained by being wrapped around the push plate and press fit retained between the push plate and the mechanical plate for a non-woven cloth is released and the retention force, either hook or press-fit is removed and the cloth falls away to a trash receptacle.

Also described, when the upper portion of each "L"-shaped member of the dual trigger activation mechanism is pushed inwardly toward the ball, each respective transverse trigger mechanism spring member bows inwardly away from a respective ratchet collar and is placed into tension and at the same time each respective ratchet tooth is removed from the respective ratchet notch in the respective ratchet collar. As a result, the force which retained the compression springs under compression is removed and the compression springs which were in a compressed state move to an uncompressed state, causing the push plate to move away from the mechanical plane by a given distance thereby releasing the retention force which retained the cloth and the cloth falls away. The push plate does not complete fall away from the mechanical plate but instead is retained a short distance "D-1" from the mechanical plate by the two fastening pins extending from the bottom surface of the push plate to being retained in a respective ratchet collar. The distance "D-1" is sufficient to disengage the hook fasteners from the microfiber cloth so that the microfiber cloth falls away and is also sufficient to release the press fit between the push plate and the mechanical plate so the non-woven cloth falls away, without a user having to touch the dirty cloth.

When a new cloth is retained against the bottom of the push plate, the pushing force on the upper portion of each "L"-shaped member of the trigger mechanism is released, the tension force on each respective transverse trigger mechanism spring member is released and each respective transverse mechanism spring member bows outwardly toward each respective ratchet collar and each respective ratchet tooth engages into the respective ratchet notch in each respective ratchet collar and the new cloth is retained against the bottom of the push plate.

It is therefore an object of the present invention to combine a yoke affixed to the mop top plate and a handle rotatably affixed to the yoke, with the mop having a dual trigger release mechanism as described above to enable the dirty cloth to be released from the mop without a user touching the dirty cloth.

Defined in detail, the present invention is a mop comprising: (a) a yoke including a base having a lower portion affixed to a flat top surface of a stationery top portion of a top plate, the yoke located at a longitudinal lengthwise center and widthwise center of the flat top surface of the top plate, the yoke including an upper portion which supports a first transverse post with a "U"-shaped retaining section and a second parallel spaced apart transverse post with a "U"-shaped retaining section, the "U"-shaped retaining sections being parallel; (b) a handle having a bottom section which includes a first extension member which is rotatably retained in said "U"-shaped retaining section of said first transverse post and the handle having a second extension member rotatably retained in said "U"-shaped retaining section of said second spaced apart transverse post to enable rotation of said handle in an arc transverse to the top plate; (c) the top plate also including spaced apart trigger activation member openings spaced at equidistant opposite sides of the yoke and extending through a thickness of the top portion of the top plate, a first trigger activation member extends through a first activation member opening and a second trigger activation member extends through a second trigger activation member opening, each trigger activation member extending perpendicular to the flat upper surface of the top plate, the first and second trigger activation members are parallel to each other, each respective trigger activation mechanism opening is sufficiently wide to enable each respective trigger activation mechanism to be pushed toward the centrally located yoke, the top plate also includes a first ratchet collar cover located on the same side as and spaced apart from the first trigger activation member opening and closer to a first end of the top plate, the top plate also including a second ratchet collar cover located on the same side as and spaced apart from the second trigger activation member opening and closer to a second end of the top plate, each respective ratchet collar cover is respectively spaced apart from a respective trigger activation member opening and each ratchet collar cover is further away from the centrally located yoke; (d) the top plate having a bottom surface which includes a first compression spring housing supporting a top of a first compression spring and a second compression spring housing supporting a top of a second compression spring; (e) a mechanical plate retained onto a bottom portion of the top plate by mating notch members on the longitudinal sidewalls of the mechanical plate and tooth members along bottom longitudinal walls of the top plate; (f) the mechanical plate including a first trigger member having a first "L"-shaped member with an upper portion extending through the first trigger activation member opening in the top plate with the upper portion of the first "L"-shaped member extending perpendicular to the top plate, a horizontal portion of the first "L"-shaped member extending to engage a first transverse trigger member spring member is further aligned with a first stop member on the top surface of the mechanical plate and at its distal end forms a first notch tooth, a second trigger member having a second "L"-shaped member with an upper portion extending through the second trigger activation member opening in the top with an upper portion of the second "L"-shaped member extending perpendicular to the top plate, a horizontal portion of the second "L"-shaped member extending to engage a second transverse trigger member spring member is further aligned with a second stop member on the top surface of the mechanical plate and at its distal end forms a second notch tooth; (g) the mechanical plate including a first ratchet collar opening adjacent said first tooth, a second ratchet collar opening adjacent said second tooth, a first compression spring opening and a second compression spring opening; (h) a push plate having a top surface including a first ratchet collar vertically aligned with the first ratchet collar cover of the top plate and spaced apart from the first operating trigger assembly of the first trigger member on the mechanical plate, the first ratchet collar having a sidewall with a first ratchet notch which receives a first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from the second operating trigger assembly of the second trigger member on the mechanical plate, the second ratchet collar has a sidewall with a second ratchet notch which receives a second notch tooth from the second trigger member, the second ratchet collar extends through aligned openings in the mechanical plate and the top plate and is received in the second ratchet collar cover on the top plate; (i) affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate; (j) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (k) a first compression spring retained at its bottom end in the first compression spring housing in the push plate, the first compression spring extending through the first compression spring opening in the mechanical plate and retained at its top end in a first compression spring housing in the top plate, a second compression spring retained at its bottom end in the second compression spring housing in the push plate, the second compression spring extending through the second compression spring opening in the mechanical plate and retained at its top end in the second compression spring housing in the top plate; (1) a pad retained onto a bottom surface of the push plate;

(m) a cloth removably retained under a bottom surface of said pad, the cloth retained by retaining members from at least the mechanical plate; and (n) wherein in an un-activated condition, the first tooth is retained in the first notch in the first ratchet collar, the second tooth is retained in the second notch in the second ratchet collar, the first and second compression springs are compressed and the cloth is removably retained, and when the first tooth is removed from the first notch and the second tooth is removed from the second notch, the first and second compression springs are converted to an un-compressed state and force the retaining members away from the cloth which falls away, the push plate travels away from the mechanical plate by a length of the shaft of the respective first and second mechanical fastening members.

Defined more broadly, the present invention is a mop comprising: (a) a handle rotatably retained by a yoke which is affixed at a central location on an upper surface of a top plate; (b) the top plate also including a first trigger activation member opening and a second trigger activation member opening which are spaced at equidistant opposite sides of the yoke and each extending through a thickness of a top portion of the top plate, the top plate also includes a first ratchet collar cover located on the same side as and spaced apart from the first trigger activation member opening and a second ratchet collar cover located on the same side as and spaced apart from the second trigger activation member opening; (c) the top plate having a bottom surface which includes a first compression spring housing supporting a top of a first compression spring and a second compression spring housing supporting a top of a second compression spring; (d) a mechanical plate retained onto a bottom portion of the top plate by mating members on the bottom portion of the top plate affixed to mating members on an upper surface of the mechanical plate; (e) the mechanical plate including a first trigger member having a first "L"-shaped member with an upper portion extending through the first trigger activation member opening in the top with the upper portion of the first "L"-shaped member extending perpendicular to the top plate, a horizontal portion of the first "L"-shaped member extending to engaging a first transverse trigger member spring member and is further aligned with a first stop member on the top surface of the mechanical plate and at its distal end forms a first notch tooth, a second trigger activation member having a second "L"-shaped member with an upper portion extending through the second trigger activation member opening in the top plate and extending perpendicular to the top plate, a horizontal portion of the second "L"-shaped member extending to engage a second transverse trigger member spring member and is further aligned with a second stop member on the top surface of the mechanical plate and at its distal end forms a second notch tooth, the first notch tooth and the second notch tooth spaced apart and facing away from each other; (f) the mechanical plate including a first ratchet collar opening adjacent said first notch tooth, a second ratchet collar opening adjacent said second notch tooth, a first compression spring opening and a second compression spring opening; (g) a push plate having a top surface including a first ratchet collar vertically aligned with the first ratchet collar cover of the top plate and spaced apart from the first operating trigger assembly of the first trigger member on the mechanical plate, the first ratchet collar having a sidewall with a first ratchet notch which receives the first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from the second operating trigger assembly of the second trigger member on the mechanical plate, the second ratchet collar having a sidewall with a second ratchet notch which receives a second notch tooth from the second trigger member, the second ratchet collar extends through aligned openings in the mechanical plate and the top plate and is received in the second ratchet collar cover on the top plate; (h) affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate; (i) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (j) a cloth removably retained under a bottom surface of said push plate, the cloth retained by retaining members from at least the mechanical plate; and (k) wherein in an un-activated condition, the first tooth is retained in the first notch in the first ratchet collar, the second tooth is retained in the second notch in the second ratchet collar, the first and second compression springs are compressed and the cloth is removably retained by the retaining members, and when the upper portion of the first L-shaped trigger activation member is pushed toward the ball and simultaneously the upper portion of the second "L"-shaped trigger activation member is pushed toward the ball, then the first tooth is removed from the first notch and the second tooth is removed from the second notch, the first and second compression springs are converted to an uncompressed state and force the retaining members away from the cloth which falls away, the push plate travels away from the mechanical plate by a length of the shaft of the respective first and second mechanical fastening members.

Defined most broadly, the present invention is a mop comprising: (a) a handle rotatably retained by a yoke which is affixed at a central location on an upper surface of a top plate; (b) a mechanical plate affixed onto said top plate, the mechanical plate including a first trigger member having a first "L"-shaped member with an upper portion extending through the top plate and a horizontal portion terminating in a first tooth, a second trigger member having a second "L"-shaped member with an upper portion extending through the top plate and a horizontal portion terminating in a second tooth, the respective upper portions of the first and second trigger member located on opposite sides of said yoke and spaced apart from the yoke with openings in the top plate to enable the respective upper portions of the first and second trigger members to move toward each other, the horizontal portions of the first and second trigger members facing away from each other; (c) a push plate having a top surface including a first ratchet collar vertically aligned with an opening in the mechanical plate adjacent said first tooth, a notch in the first ratchet collar into which the first tooth is inserted under spring pressure, a second ratchet collar vertically aligned with an opening in the mechanical plate adjacent said second tooth, a notch in the second ratchet collar into which the second tooth is inserted under spring pressure; (d) at least one compression spring retained at a top end in the top plate and at a bottom end retained in the push plate, the at least one compression spring extending through an aligned opening in the mechanical plate; (e) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (f) a cloth removably retained under a bottom surface of said push plate, the cloth retained by retaining members from at least the mechanical plate; and (g) wherein in an un-activated condition, the first tooth is retained in the first notch in the first ratchet collar, the second tooth is retained in the second notch in the second ratchet collar, the at least one compression spring is compressed and the cloth is removably retained by the retaining members, and when the upper portion of the first "L"-shaped trigger activation member is pushed toward the ball and simultaneously the upper portion of the second "L"-shaped trigger activation member is pushed toward the yoke, then the first tooth is removed from the first notch and the second tooth is removed from the second notch, the first and second compression springs are converted to an un-compressed state and force the retaining members away from the cloth which falls away, the push plate travels away from the mechanical plate by a length of the shaft of the respective first and second mechanical fastening members.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated:

FIG. 4A1 is a top perspective view of the mechanical plate with the dual trigger mechanism in the un-activated condition;

FIG. 4A2 is a top side perspective view of the mechanical plate with the dual trigger mechanism in the activated condition;

FIG. 7-1, FIG. 7-2 and FIG. 7-3 are continuation sheet drawings,

FIG. 7-1 is an exploded view illustrating a bottom perspective view of the cover plate and a bottom perspective view of the first embodiment of the mechanical plate, FIG. 7-2 is an exploded perspective view illustrating a top perspective view of the first embodiment of the push plate and a top perspective view of a first embodiment of the pad, FIG. 7-3 is a perspective view of a microfiber cloth;

FIG. 12-1 and FIG. 12-2 are continuation sheet drawings,

FIG. 12-1 is an exploded view illustrating a bottom perspective view of the cover plate and a bottom perspective view of the second embodiment of the mechanical plate;

FIG. 12-2 is an exploded perspective view illustrating a top perspective view of the second embodiment of the push plate, a top perspective view of the second embodiment of the pad used with the push plate, and a top perspective view of the non-woven cloth;

DETAILED DESCRIPTION OF THE EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

The present invention is a dual trigger mechanism to release a disposable microfiber cloth or non-woven cloth from a flat mop combined with a yoke affixed to the top surface of the top plate and a handle rotatably affixed to the yoke with the handle rotatable in the direction of 180 degrees relative to the yoke. There are five major components in the present invention: (1) a yoke affixed to the top plate and a handle rotatably retained in the yoke to enable the handle to rotate one-hundred eighty (180) degrees relative to the yoke, the yoke centrally affixed to the top surface of the top plate; (2) a top plate; (3) a mechanical plate with a dual trigger mechanism incorporated into the mechanical plate; (4) a push plate; and (5) a pad made of material such as foam or rubber below the push plate. In one variation, the invention retains a microfiber cloth or cloth made out of similar material. In an alternative variation, the invention retains a non-woven cloth or cloth made out of similar material.

Figure 1:
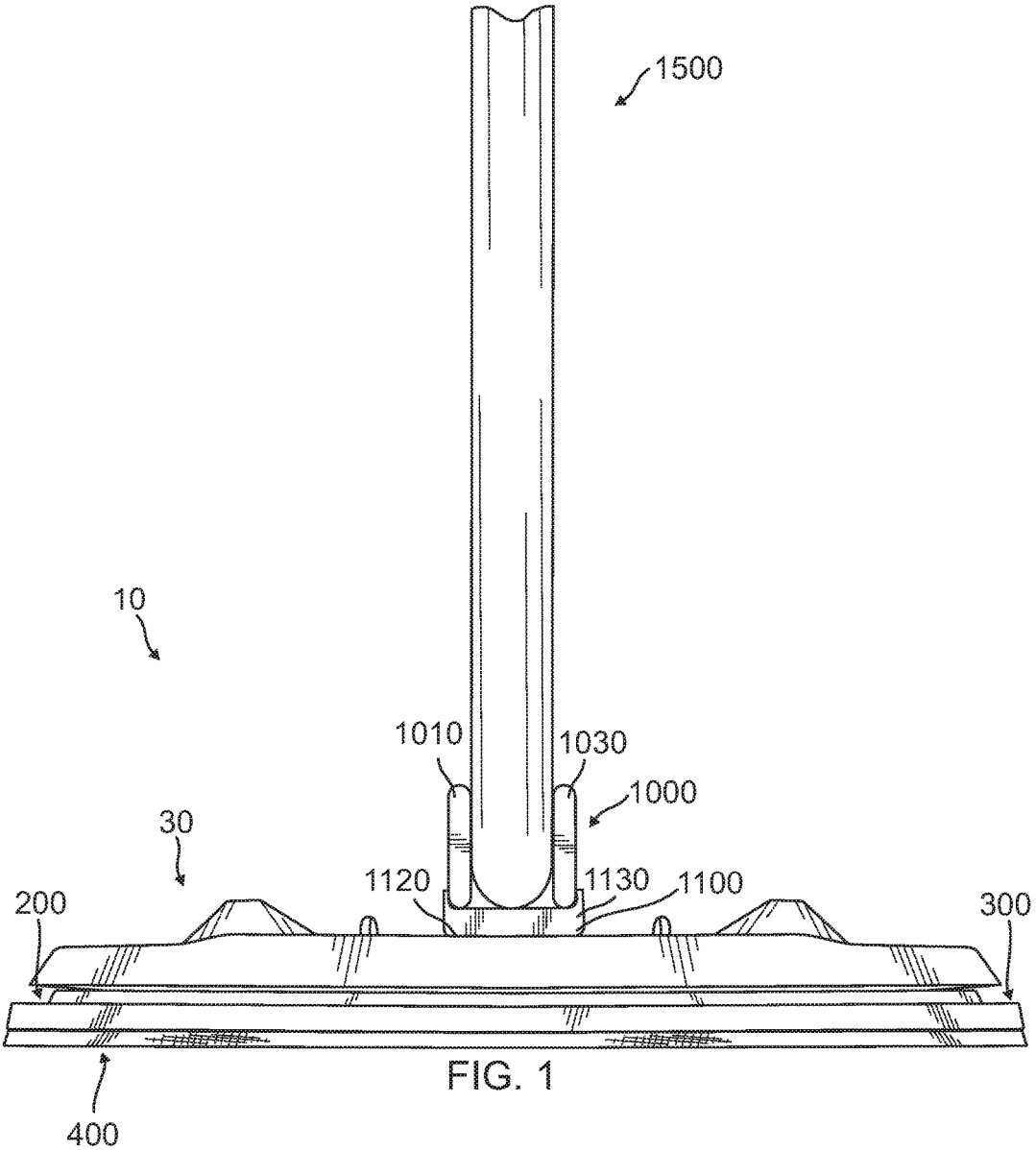
FIG. 1 is a side elevational view of the first embodiment of the present invention yoke rotatably retaining the handle, the yoke affixed to the top plate, and also illustrating the flat mop in the un-activated condition.
Figure 2:
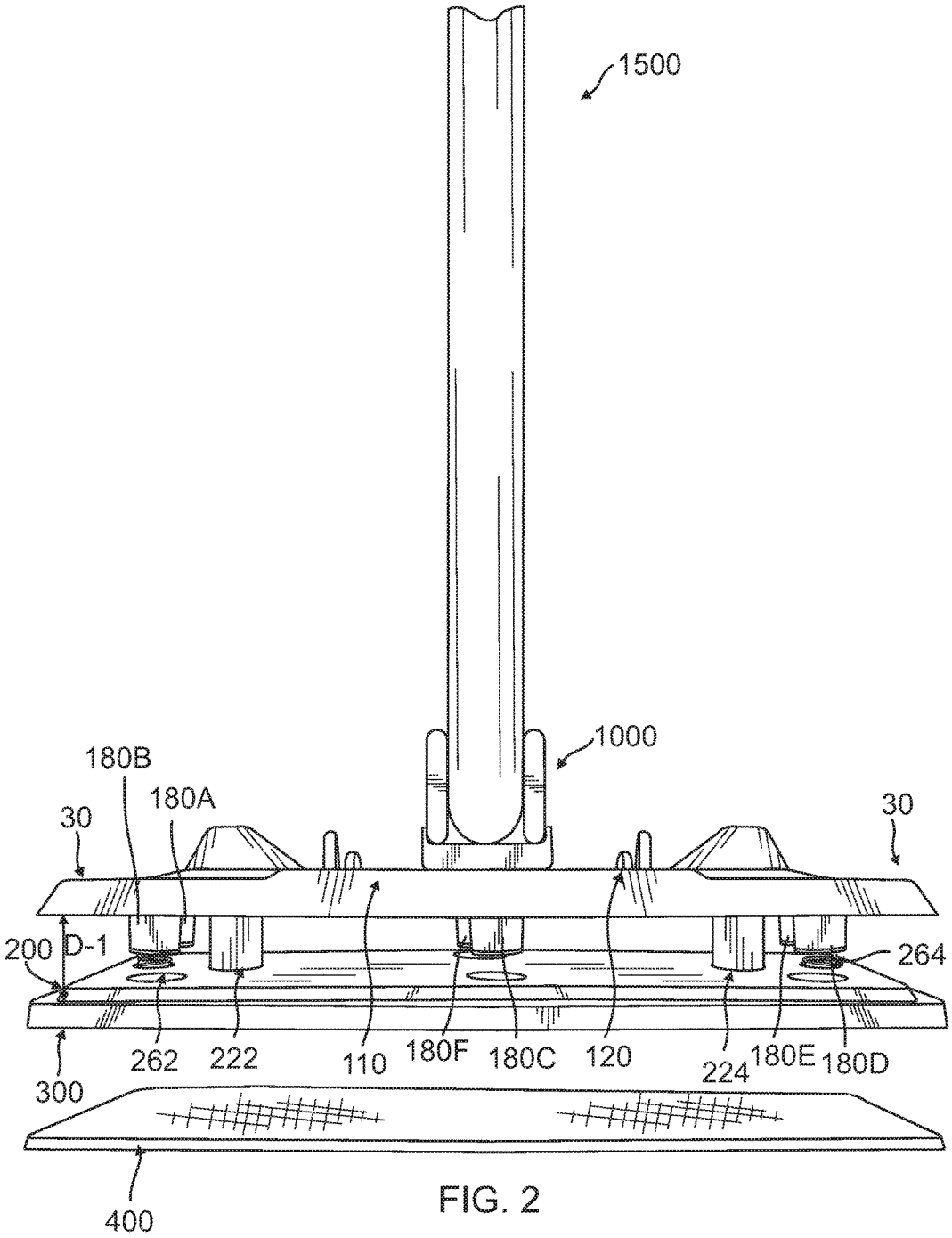
FIG. 2 is an exploded side perspective view of the first embodiment of the present invention present invention yoke affixed to the top plate and the handle rotatably affixed to the yoke, and also illustrating the flat mop in the activated condition.
Figure 2A:
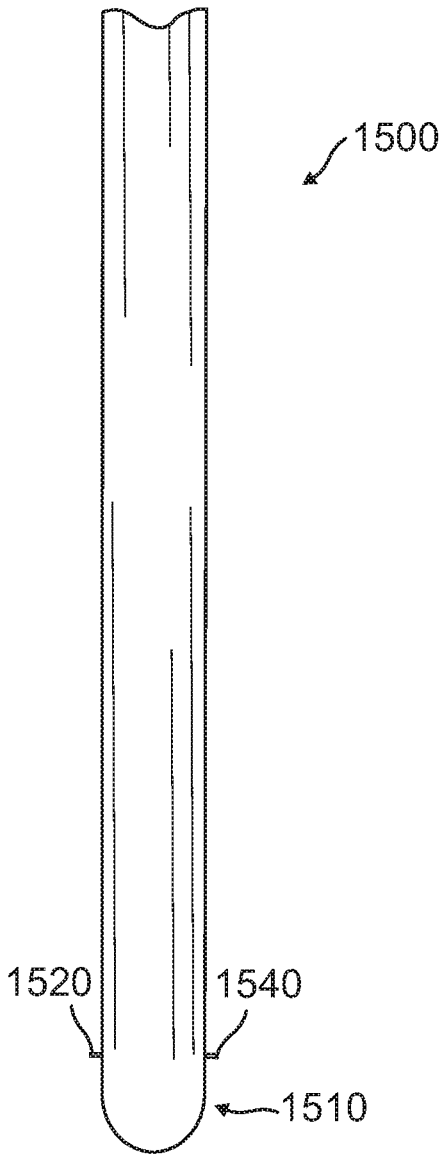
FIG. 2A is a side elevational view of a portion of the mop handle illustrating the pins located at the bottom of the mop handle by which it is rotatably attached to the yoke.
Figure 2B:
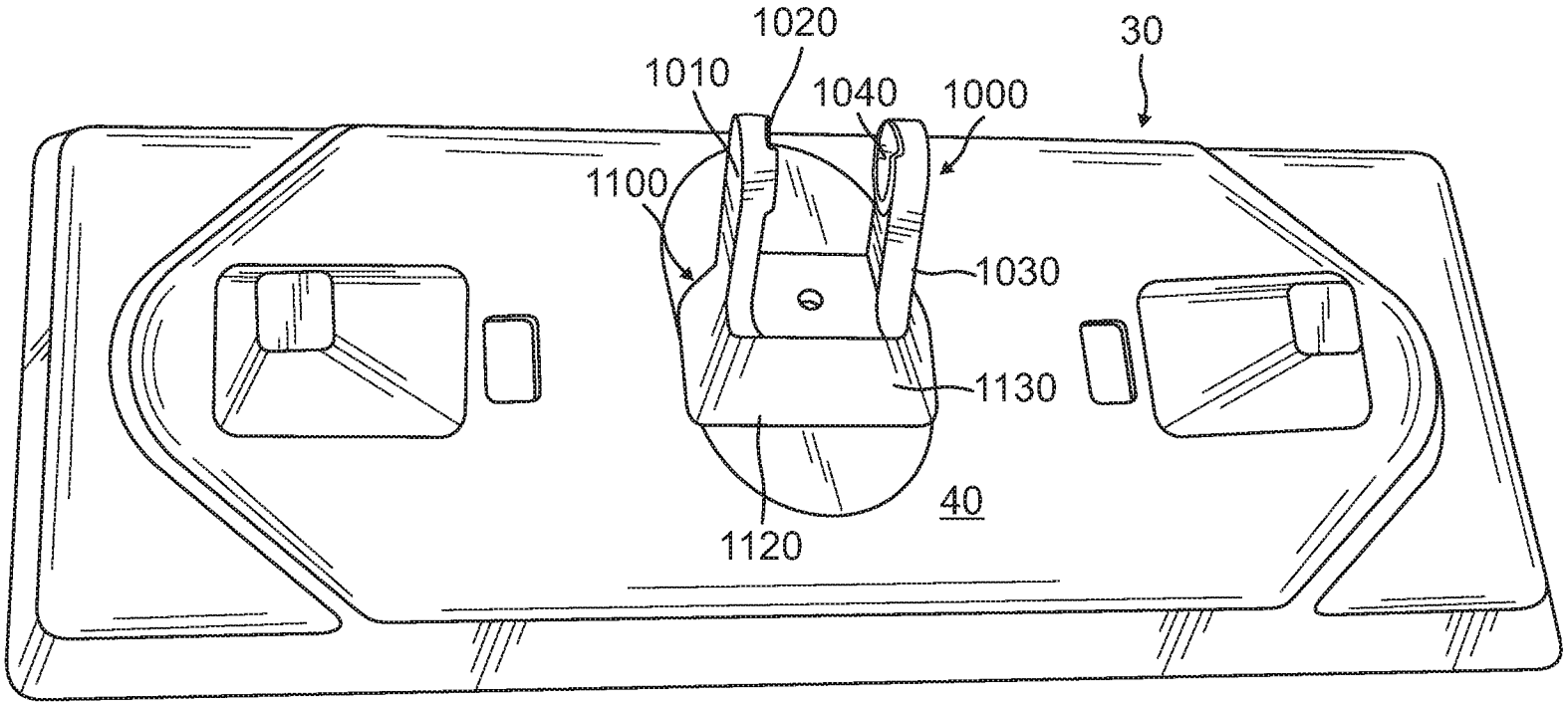
FIG. 2B is a top perspective view of the top plate illustrating the yoke with the mop handle removed to illustrate the openings by which the mop handle is rotatably retained by the yoke, also illustrating the yokes centrally affixed to the top surface of the top plate.

Referring to FIG. 1, there is illustrated a top-side elevational view of the first embodiment of the present invention in the un-activated condition with the yoke centrally affixed to the top plate with the yoke rotatably retaining the mop handle, and also illustrating the flat mop in the un-activated condition. Referring to FIG. 2, there is illustrated an exploded side perspective view of the first embodiment of the present invention in the activated condition with the yoke centrally affixed to the top plate with the yoke rotatably the mop handle, and also illustrating the flat mop in the activated condition. Referring to FIG. 2A, there is illustrated a top-side elevational view of the top plate 30 with the yoke in the open conditional without the mop handle attached. Referring to FIG. 2B, there is illustrated a top-side elevational view of the top plate with the yoke rotatably retaining the handle, the yoke centrally affixed to the top surface of the top plate.

Referring to FIG. 1, the present invention flat mop with yoke rotatably supporting the mop handle and the dual trigger is numbered 10. The present invention flat mop with yoke, handle ad dual trigger 10 is generally comprised of top plate 30, mechanical plate 100 (which is retained within the top cover and therefore not visible in FIG. 1, but which will be described later on in this application), a push plate 200 (which is only partially visible in FIG. 1 but which will be described in greater detail later in his application), a rubber or foam pad 300 and a microfiber cloth 400 retained against the foam or rubber pad 300 by retaining members from the mechanical plate 100 as will be described. Also illustrated is the handle 1500 rotatably retained in the yoke 1000.

Referring to FIG. 1 and to FIG. 2B, there is the present invention flat mop 10 with yoke 1000 including a base 1100 having a lower portion 1120 affixed to the top plate 30. The yoke 1000 includes an upper portion 1130 which supports a first transverse post 1010 with a "U"-shaped retaining section 1020 and a second parallel spaced apart post 1030 with a "U"-shaped retaining section 1040. The "U"-shaped retaining sections 1020 and 1040 are parallel. Referring to FIG. 1 and to FIG. 2A, a handle 1500 has a bottom section 1510 which includes extension members 1520 and 1540 which are respectively rotatably retained in "U"-shaped retaining sections 1020 and 1040. It will be appreciated that any type of rotatable joining members between the bottom section 1510 of handle 1500 a yoke 1000 which enables the handle 1500 to rotate one-hundred and eighty (180) degrees about yoke 1000 is within the spirit and scope of the present invention.

Referring to FIG. 2, there is illustrated a front elevational view of the first alternative embodiment of the present invention flat mop with yoke affixed to the top plate and handle rotatably retained by the yoke, and dual trigger 10 in an activated position illustrating a portion of the first ratchet collar 222, a portion of a second ratchet collar 224, a portion of a first compression spring 262 and a portion of a second compression spring 264. Also illustrated is a portion of six retaining member posts 180A, 180B, 180C, 180D, 180E and 18F. When activated by dual triggers 110 and 120 are simultaneously pressed together, this allows flat mop with yoke rotatably retaining a handle and dual trigger 10 to transition from the closed position illustrated in FIG. 1 to the open position in FIG. 2. As will be described, the push plate 200 is forced away from the mechanical plate by a distance "D-1", releasing the retention force on the microfiber cloth 400 enabling the microfiber cloth 400 to fall away. The push plate 200 and pad 300 only travel by the distance "D-1" due to retention pins, as will be described.

Figure 3A:
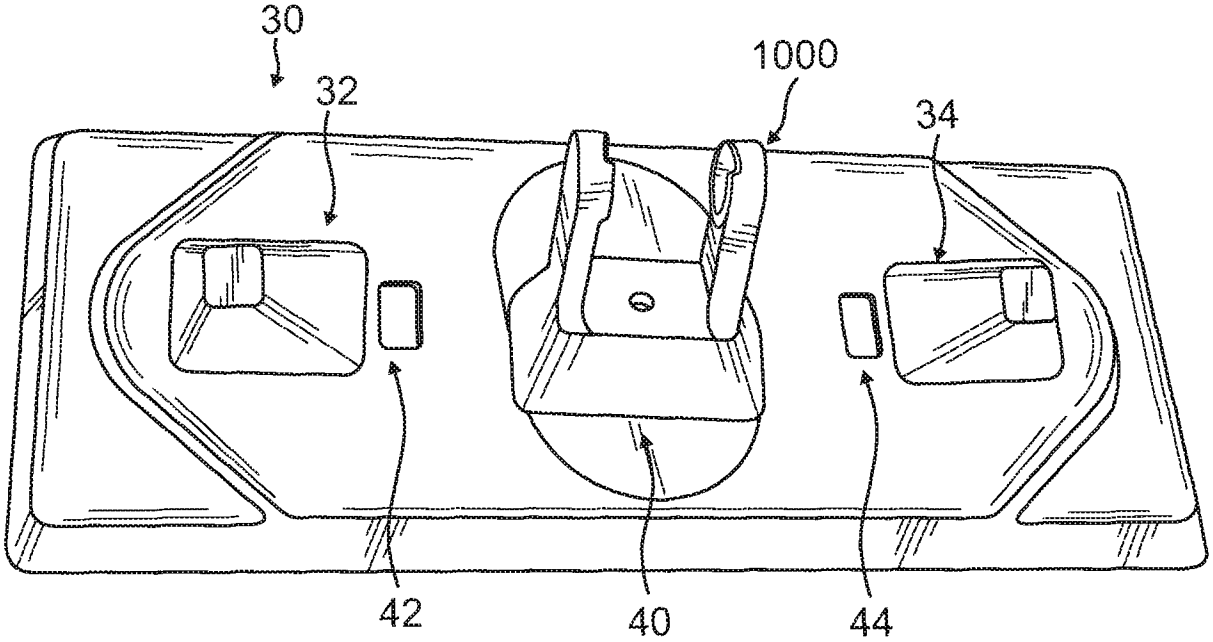
FIG. 3A is a top perspective view of the top plate of the present invention illustrating the additional components of the top plate in addition to the yoke with the mop handle removed.
Figure 3B:
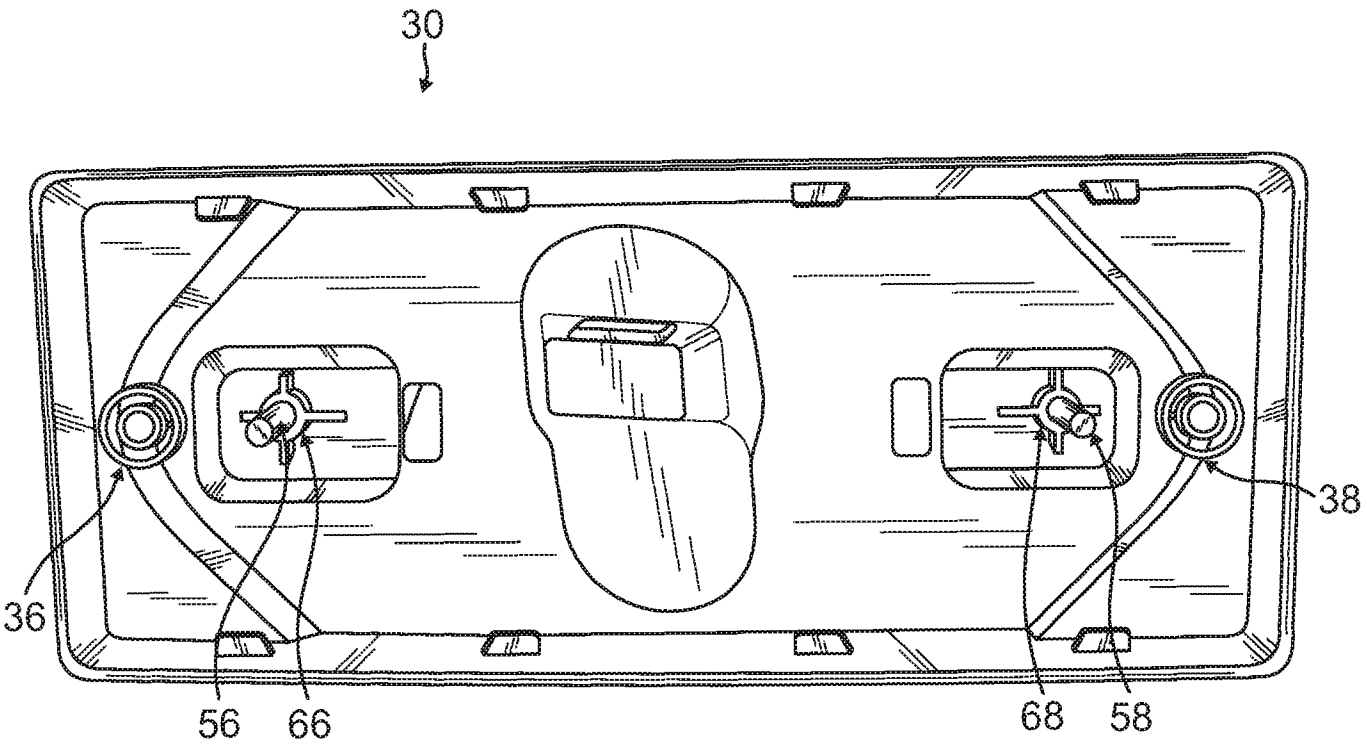
FIG. 3B is a bottom perspective view of the top plate of the present invention.

Referring to FIGS. 3A and 3B, there is illustrated the top and bottom views respectively of top cover 30. Referring to FIG. 3A, there is illustrated top view of top cover 30 illustrating two ratchet collar covers 32 and 34. Located on top upper surface 40 of top cover 30 and between yoke 1000 and ratchet collar covers 32 and 34 are trigger activation member openings 42 and 44 that provide an opening for dual trigger activation members 110 and 120 to pass through and be accessible for a user. The bottom view of top cover 30 illustrated by FIG. 3B shows a top cover bottom having a first top compression spring housing 36 and a second top compression spring housing 38. First top compression spring housing 36 and second top compression spring housing 38 assist in retaining first compression spring 262 and second compression 264 in a vertical position while the present invention converts from the closed position or useable position shown in FIG. 1 to the open position or cloth changing position shown in FIG. 2.

Figure 5A:
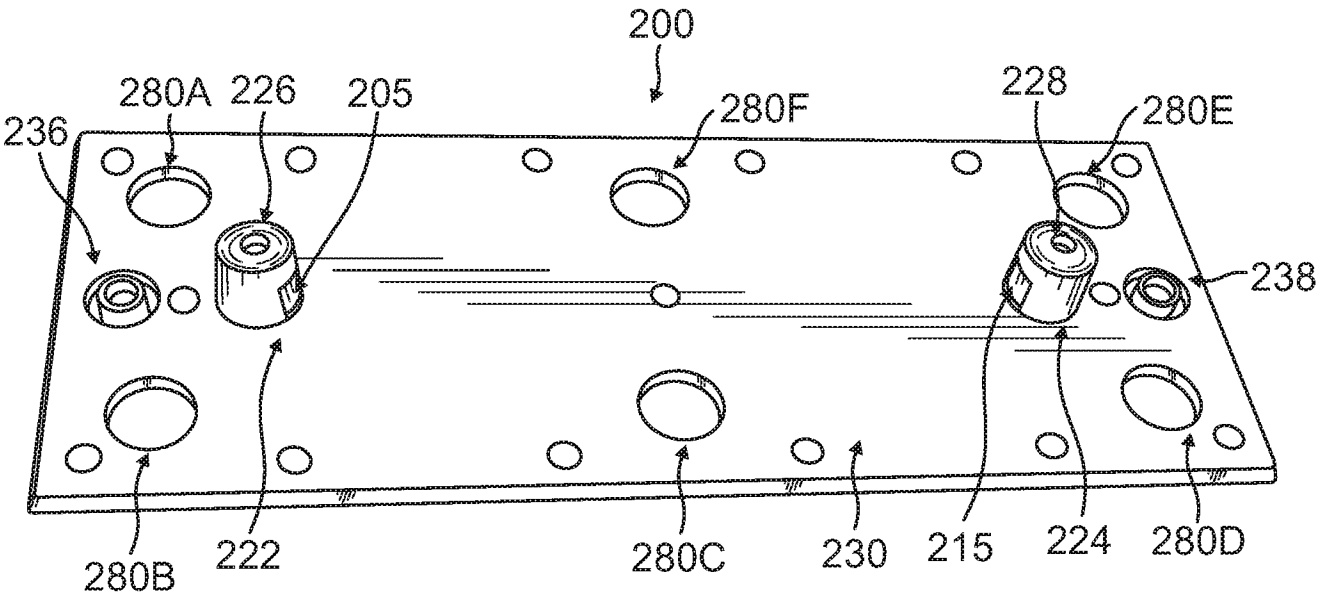
FIG. 5A is a top perspective view of the first embodiment of the push plate.

Further referring to FIGS. 1, 2, and 3B, there is illustrated a first post or first retaining pin 56 and a second post or second retaining pin 58 that respectively fit into a first ratchet hole 226 and a second ratchet hole 228 (illustrated in FIG. 5A). FIG. 3B also illustrates first post 56 and second post 58 which provide a slidable path by which the push plate 200 and the pad 300 (which are press fit together) slide downwardly when the present invention flat mop with yoke retaining member and dual trigger 10 transitions from the closed position illustrated in FIG. 1 to the open position illustrated in FIG. 2. Left post connector 66 and right post connector 68 retain top cover 30 and mechanical plate 100 respectively to first post 56 and second post 58 when separate from upper push plate 200 and lower push plate 300. The length of first post 56 and second post 58 coupled with the location of left post connector 66 and right post connector 68 provide the length of travel that upper push plate 200 and lower push plate 300 can slide. Further, these components working in conjunction with left fastening pin 274 and right fastening pin 284 (illustrated in FIG. 5B) allow upper push plate 200 and pad 300 to expand a distance approximately equal to the length of first post 56 and second post 58, but not beyond this length.

Referring to FIGS. 3A and 3B, top cover 30 includes dual trigger activation member openings 42 and 44 with an opening which enables a first trigger activation member 110 to extend through first trigger activation member opening 42 and further extend perpendicular to the top upper surface 40 of top cover 30 and located spaced apart from yoke 1000. A second trigger activation member opening 44 enables a second activation member 120 to extend through second trigger activation member opening 44 and further extend perpendicular to top upper surface 40 of top cover 30 and located spaced apart from said yoke 1000. First or left trigger opening 42 and second or right trigger opening 44 are parallel to each other and are located on opposite locations relative to yoke 1000.

Referring to FIGS. 4A1 and 4A2, there is illustrated two top views of mechanical plate 100. FIG. 4A1 illustrates the top view of mechanical plate 100 illustrating a first or left trigger assembly 102 having a left central shaft 104 with left central shaft 104 having a left upper wing 107 and a left lower wing 108 that extend generally perpendicular and away from left central shaft 104. Left central shaft 104 is also slidably affixed to top mechanical surface 130 of mechanical plate 100 by left trigger assembly housing 106. Left central shaft 104 and left upper wing 107 and a left lower wing 108 are formed from a flexible material such as spring plastic to allow left upper wing 107 and a left lower wing 108 to bend and store potential energy when left trigger 110 is pressed inwardly towards right trigger 120.

Similarly, FIG. 4A1 also illustrates the top view of mechanical plate 100 illustrating a second or right trigger assembly 112 having a right central shaft 114 with right central shaft 114 having a right upper wing 117 and a right lower wing 118 that extend generally perpendicular and away from right central shaft 114. Right central shaft 114 is also slidably affixed to top mechanical surface 130 of mechanical plate 100 by right trigger assembly housing 116. Right central shaft 114 and right upper wing 117 and a right lower wing 118 are formed from a flexible material such as spring plastic to allow right upper wing 117 and a right lower wing 118 to bend and store potential energy when right trigger 120 is pressed inwardly towards left trigger 110.

In operation, when left trigger 110 and right trigger 120 (which have also been referred to as first trigger activation member 110 and second trigger activation member 120) are pressed inward together, shaft left end 105 and shaft right end 115 move inward and out of respective ratchet collar notches 205 and 215, left ratchet collar 222 and right ratchet collar 224 thereby exposing entirely left mechanical plate ratchet hole 148 and right mechanical plate ratchet hole 158. When left mechanical plate ratchet hole 148 and right mechanical plate ratchet hole 158 are entirely exposed and not covered by any portion of shaft left end 105 and shaft right end 115 as illustrated in FIG. 4A2, left compression spring 262 and right compression spring 264 are allowed to expand from their respective compressed states to force upper push plate 200 and lower push plate 300 to expand to a position approximately 2 inches below top cover 30. This is best illustrated by FIG. 2 where present invention flat mop with yoke retaining member and dual trigger 10 are illustrated in the open position.

Simultaneously occurring with the inward movement of left trigger assembly 102 and right trigger assembly 112 when left trigger 110 and right trigger 120 are pressed inwardly is the bending of left upper wing 107, left lower wing 108, right upper wing 117, and right lower wing 118. This bending is caused by the inward force acting upon left trigger assembly 102 and right trigger assembly 112 which causes all four wing walls to bend around left stoppers 142A, 142B, 142C, 142D and right stoppers 152A, 152B, 152C, and 152D. All four wings transition from a convex resting position when dual triggers are at a resting outer position (illustrated in FIG. 4A1) to an inward concave position (illustrated in FIG. 4A2) when left trigger 110 and right trigger 120 are pressed inwardly. When left trigger 110 and right trigger 120 are released, all four wings exercise a spring force to return left trigger assembly 102 and right trigger assembly 104 to their initial resting outer position (illustrated in FIG. 4A1).

Figure 4B:
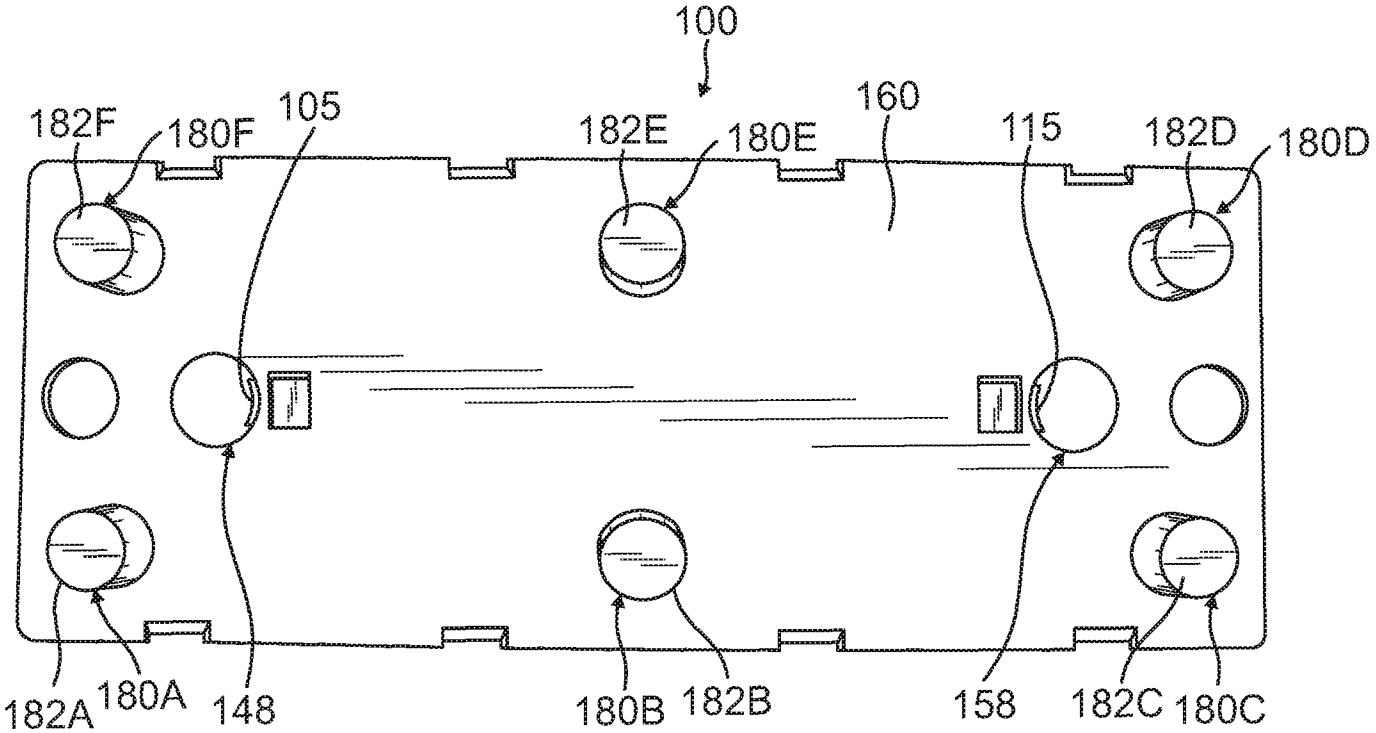
FIG. 4B is a bottom perspective view of a first alternative embodiment of the mechanical plate.

Referring to FIGS. 4A2 and 4B, there is illustrated a top view of mechanical plate 100 and a bottom view of mechanical plate 100 respectively. FIG. 4A2 illustrates a multiplicity of cloth retaining members 180A, 180B, 180C, 180D, 180E and 180F to enable a cloth to be retained by hook fasteners. Each respective distal end of cloth retaining members 180A, 180B, 180C, 180D, 180E and 180F have cloth retaining ends 182A, 182B, 182C, 182D, 182E and 182F that is made of either a hook material or a fastener material.

Referring to FIGS. 4B, 5A, 5B, 6A, and 6B, cloth retaining members 180A, 180B, 180C, 180D, 180E and 180F fit through push plate openings 280A, 280B, 280C, 280D, 280E and 280F and pad openings 380A, 380B, 380C, 380D, 380E and 380F to allow cloth retaining members 180A, 180B, 180C, 180D, 180E and 180F to be exposed at the bottom of the first embodiment flat mop with yoke retaining member and dual trigger 10. Collectively cloth retaining ends 182A, 182B, 182C, 182D, 182E and 182F which are comprised of either a hook or fastener material will retain a micro fiber cloth 400 (not illustrated) that also has either hook or fastener material affixed to the micro fiber cloth.

Figures 1, 7:
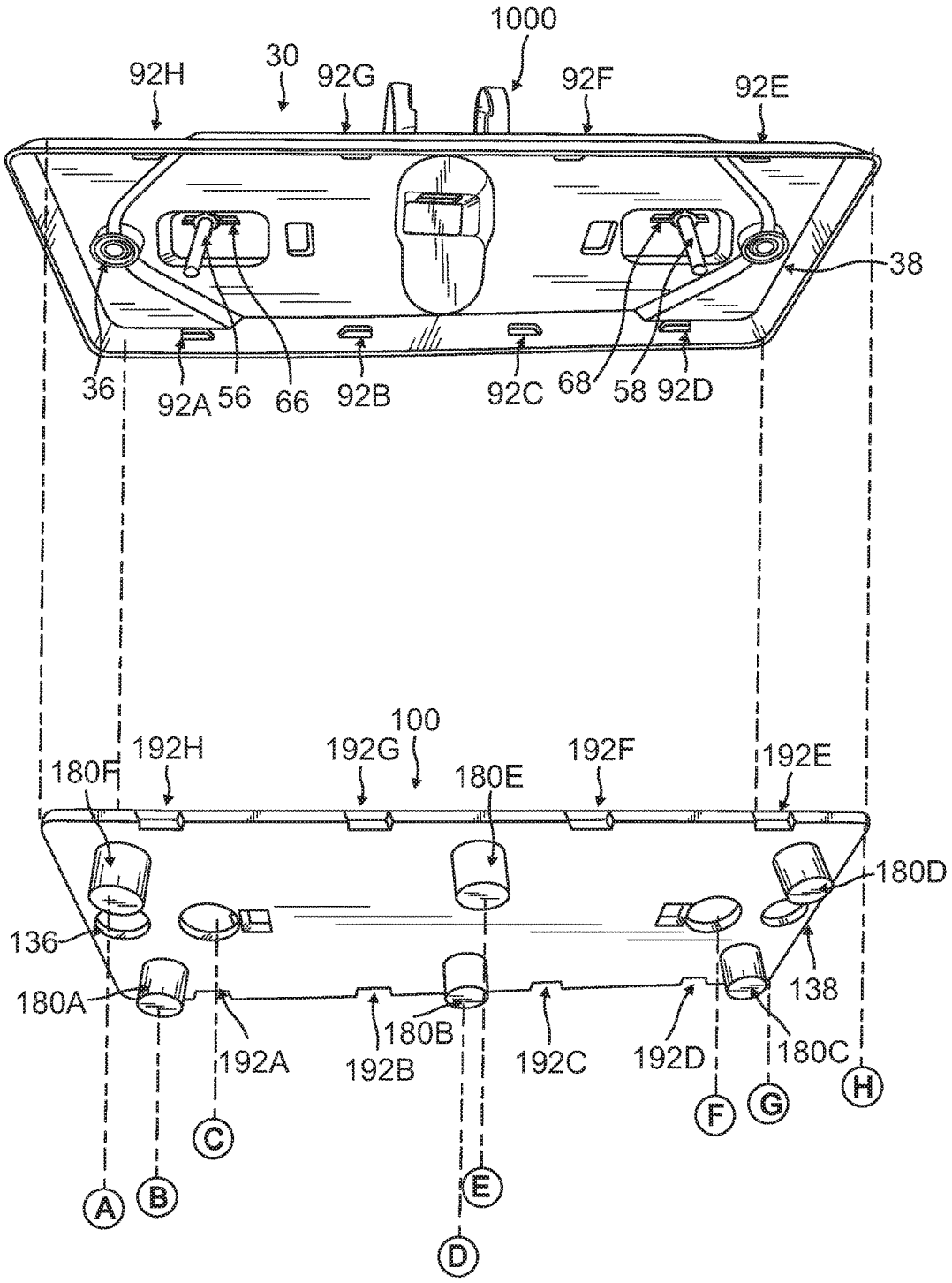
Figures 2, 7:
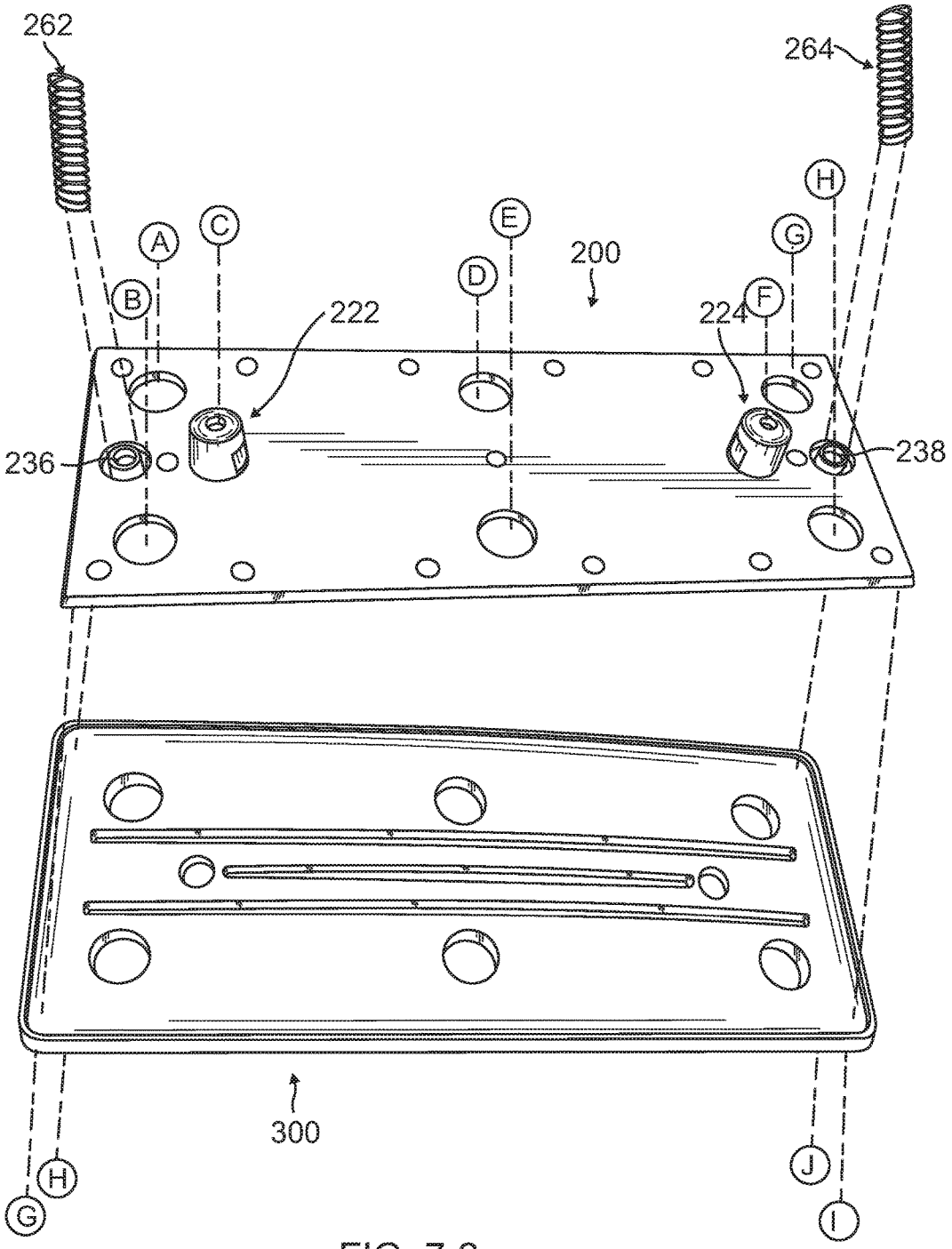
Figures 3, 7:
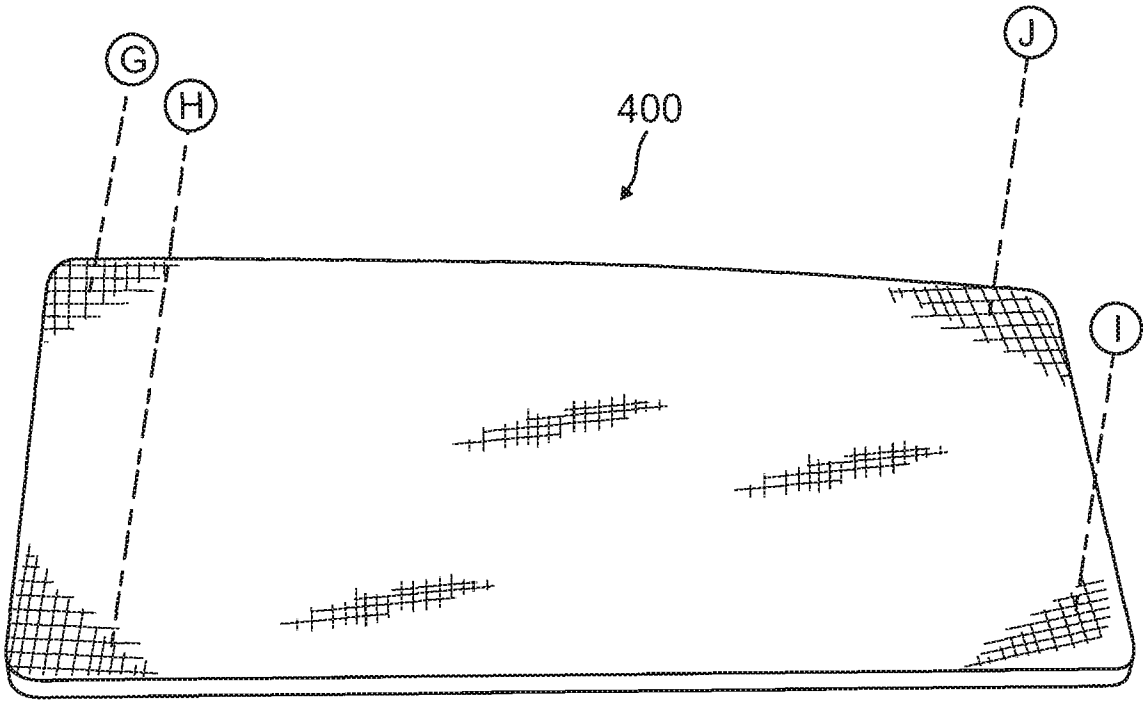

Referring to FIGS. 5A and 7, there is illustrated a first upper press plate compression spring housing 236 and a second upper press plate compression spring housing 238. Compression springs 262 and 264 are retained respectively within first upper press plate compression spring housing 236 and second upper press plate compression spring housing 238 and first top compression spring housing 36 and second top compression spring housing 38.

Figure 5B:
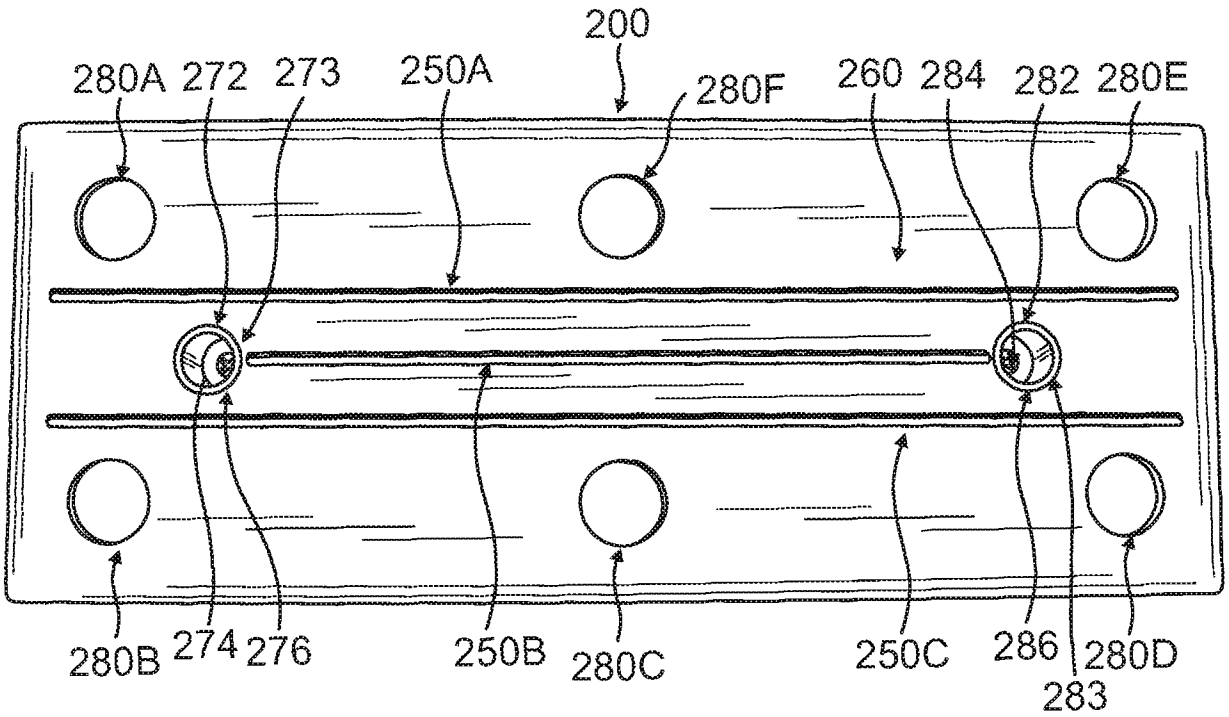
FIG. 5B is a bottom perspective view of the first embodiment of the push plate.

Referring to FIG. 5B, there is a bottom perspective view of push plate 200, illustrating push plate openings 280A, 280B, 280C, 280D, 280E and 280F. Also illustrated is a first or left fasting pin opening 272 and a second or right fastening pin opening 282 that extend upward from upper push plate bottom surface 260 and respectively through cylindrical chambers 273 and 283 to smaller circular openings second left fasting pin opening 276 and second right fasting pin opening 286. Left fastening pin 274 and a right fastening pin 284 have larger diameters than second left fasting pin opening 276 and second right fasting pin opening 286 to retain upper push plate 200 from becoming detached from first post 56 and second post 58. Therefore, upper push plate 200 will extend to a maximum distance equal to the lengths of first post 56 and second post 58 and will remain affixed along first post 56 and second post 58 during the opening and closing of the present invention flat mop with yoke retaining member and dual trigger 10.

Figure 6A:
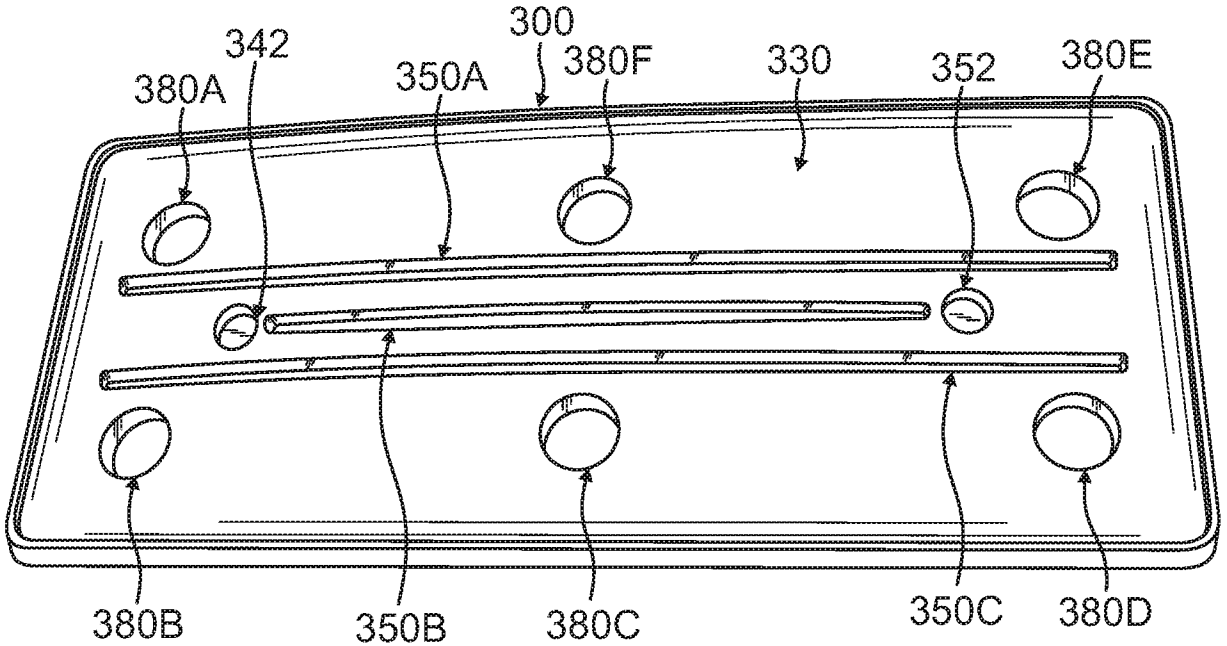
FIG. 6A is a top perspective view of the first embodiment of a rubber or foam pad below the push plate.
Figure 6B:
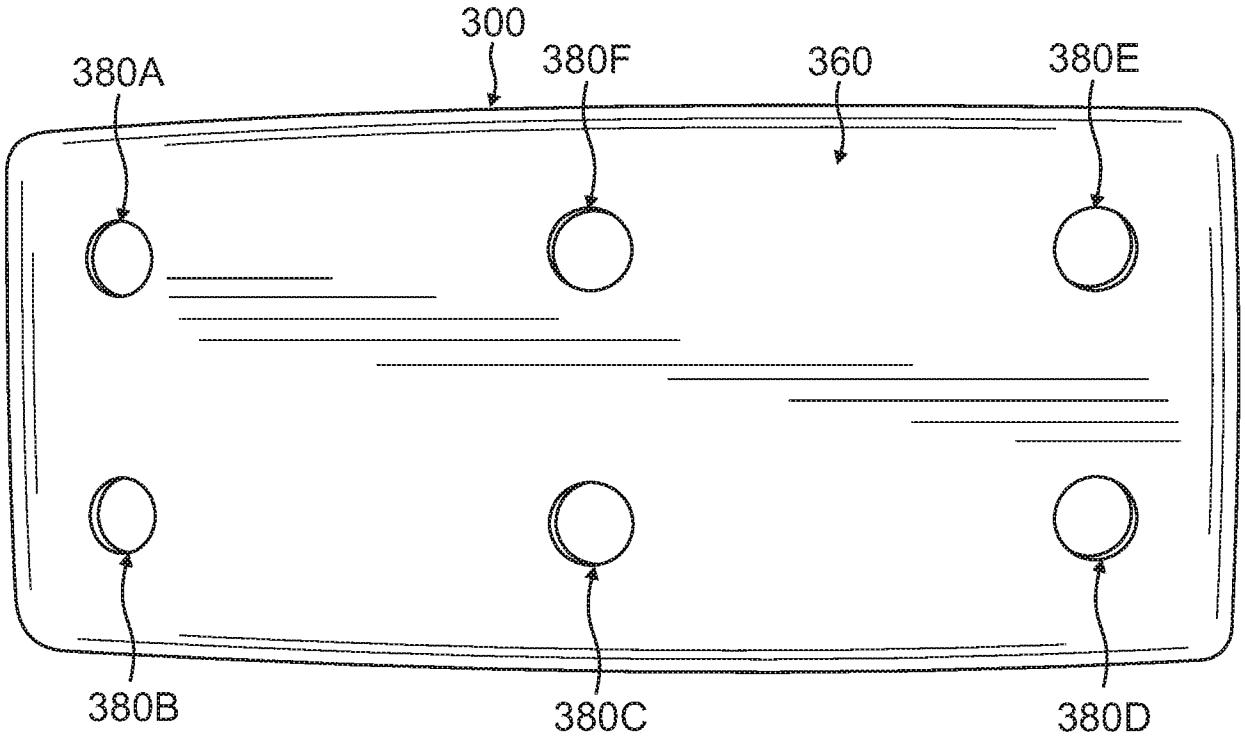
FIG. 6B bottom perspective view of the first embodiment of the rubber or foam pad below the push plate.

Referring to FIGS. 5B, 6A, 6B, and 7 there is illustrated pad plate 300 having a pad upper surface 330 and a pad bottom surface 360. Pad upper surface 330 has female slots 350A, 350B, and 350C (FIG. 6) that receive male slots 250A, 250B, and 250C (FIG. 5B) to press fit retain pad 300 to push plate 200. Alternatively, the pad 300 is retained to the push late 200 by adhesive. Also illustrated in FIG. 6A are pad openings 380A, 380B, 380C, 380D, 380E and 380F to allow cloth retaining members 180A, 180B, 180C, 180D, 180E and 180F to be exposed at the bottom of the first embodiment flat mop with yoke retaining member and dual trigger 10. Pad upper surface 330 also respectively has a left opening 342 and a right opening 352 that respectively form the bottom surface that left fastening pin 274 and a right fastening pin 284 abut.

Referring to FIGS. 7-1, 7-2 and 7-3, there is illustrated an exploded view of the present invention flat mop with yoke retaining member and dual trigger 10 illustrating top cover 30, mechanical plate 100, push plate 200, pad push plate 300 and microfiber cloth 400. Top cover 30 has eight male connectors 92A, 92B, 92C, 92, 92E, 92F, 92G, and 92H that connect respectively to eight female connectors 192A, 192B, 192C, 192D, 192E, 192F, 192G, and 192H located on mechanical plate 100 to removably affix top cover 30 to mechanical plate 100. Therefore, in operation when the present invention flat mop with yoke retaining member and dual trigger 10 transitions from the closed position to the open position, top cover 30 and mechanical plate 100 remain affixed together.

Similarly, push plate 200 is press fit retained or adhesively retained as previously explained to pad 300. Pad 300 and push plate 200 move together as one piece when present invention flat mop with yoke retaining member and dual trigger 10 transitions from the closed position (illustrated in FIG. 1) to the open position (illustrated in FIG. 2).

FIG. 7-1 shows first top compression spring housing 36, and second top compression spring housing 38, and FIG. 7-2 shows first lower spring housing 236 and second lower spring housing 238. First top compression spring housing 36, second top compression spring housing 38, first lower spring housing 236 and second lower spring housing 238 respectively retain first compression spring 262 and second compression spring 264 when the present invention flat mop with yoke retaining member and dual trigger 10 transitions from the closed position illustrated in FIG. 1 to the open position illustrated in FIG. 2.

First post 56 which is also fastening pin 274 and second post 58 which is also fastening pin 284 provide the posts that top cover 30 slides upward along when top cover 30 opens from the closed position. Left post connector 66 and right post connector 68 provide the means by which top cover 30 is retained along first post 56 and second post 58. First post 56 and second post 58 respectively fit into a first ratchet hole 226 and a second ratchet hole 228 (illustrated in FIG. 5A).

Figure 8A:
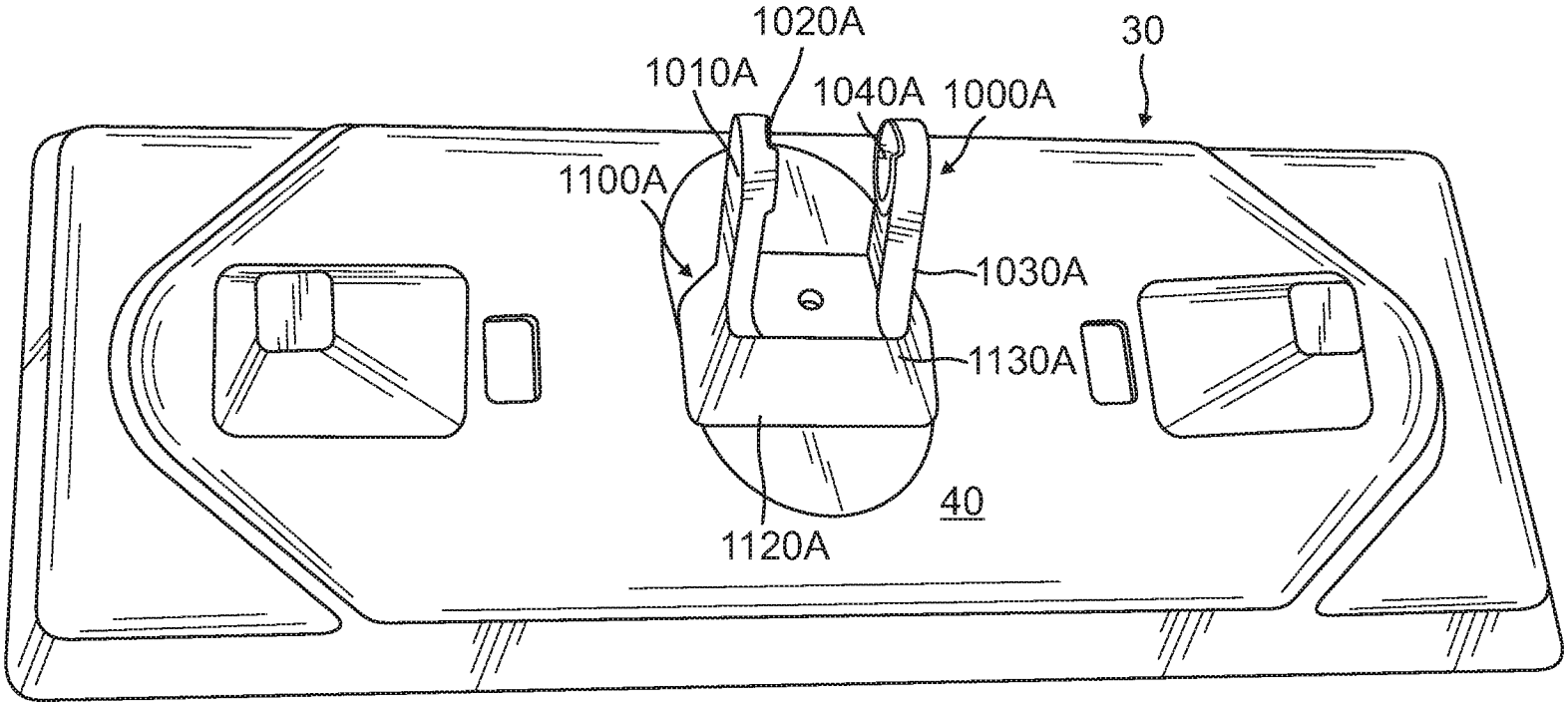
FIG. 8A is a top perspective view of the top plate of the present invention, illustrated for discussion of the second embodiment of the present invention further illustrating the yoke with the mop handle removed.
Figure 8B:
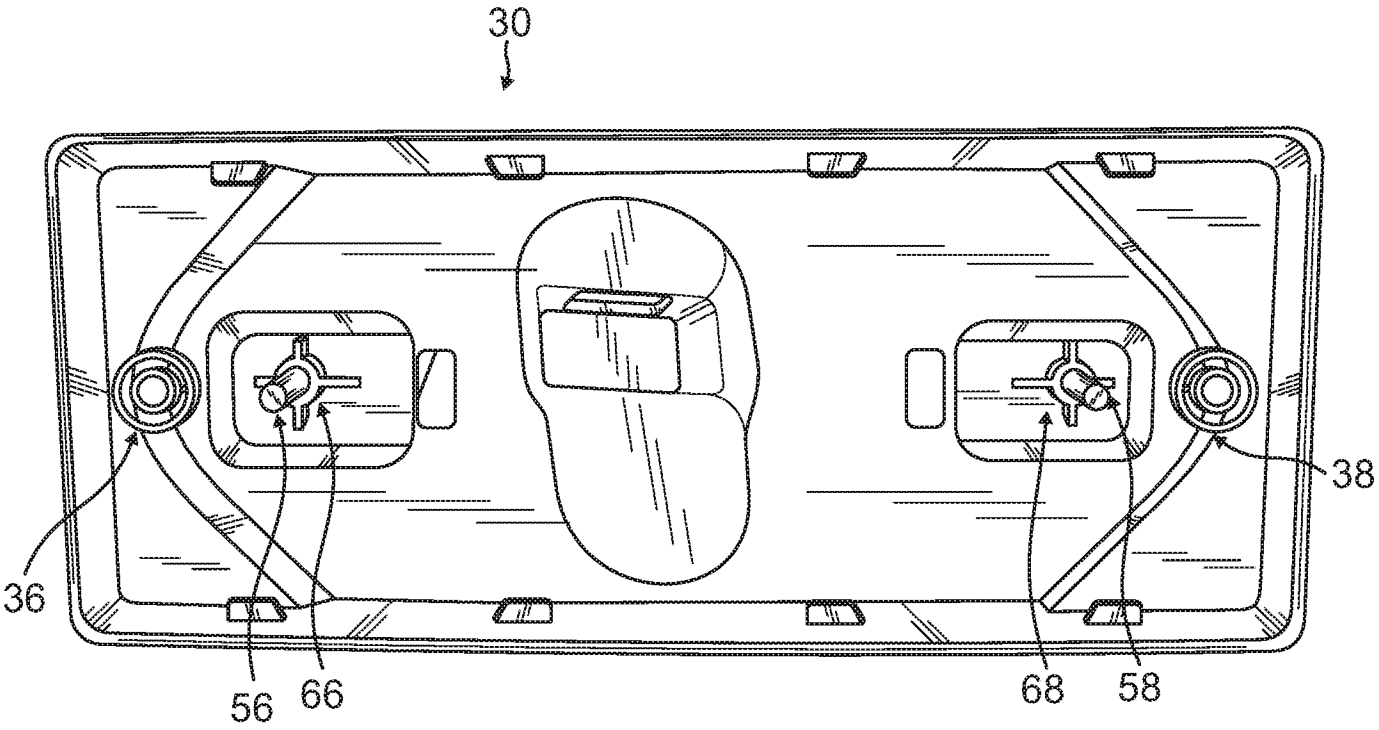
FIG. 8B is a bottom perspective view of the top plate of the present invention, illustrated for discussion of the second embodiment of the present invention.

Referring to FIGS. 8A and 8B, there is illustrated a top and bottom view of the second embodiment present invention flat mop with yoke retaining member and dual trigger 10. The components in FIG. 8A are numbered corresponding to the components as illustrated in FIG. 2B but the letter "A" is added at the end of each number to designate that it is referring to the alternative embodiment. The difference between the first embodiment (illustrated in FIGS. 3A to 7) and the second embodiment (illustrated in FIGS. 8A to 12) are the methods by which the cloth is retained to the present invention flat mop with yoke retaining member and dual trigger 10. In the first embodiment, microfiber cloth 400 is retained to the present invention by use of hook fasteners. In the second embodiment, the non-woven cloth 1400 is retained to the present invention by means of female and male mating members or teeth that retain non-woven cloth 1400 until dual triggers 110 and 120 (which function collectively, with top cover, ratchet collars, posts, compression springs, and fastening pins as previously described and identical to the first embodiment) are pressed simultaneously together to allow the flat mop with yoke retaining member and dual trigger 10 to transition from the closed position illustrated in FIG. 1 to the open position illustrated in FIG. 2. The six cloth retaining members and corresponding holes in the first embodiment are replaced by female mating members on the bottom surface of the mechanical plate and male mating members on the upper surface of the upper push plate.

Figure 9A:
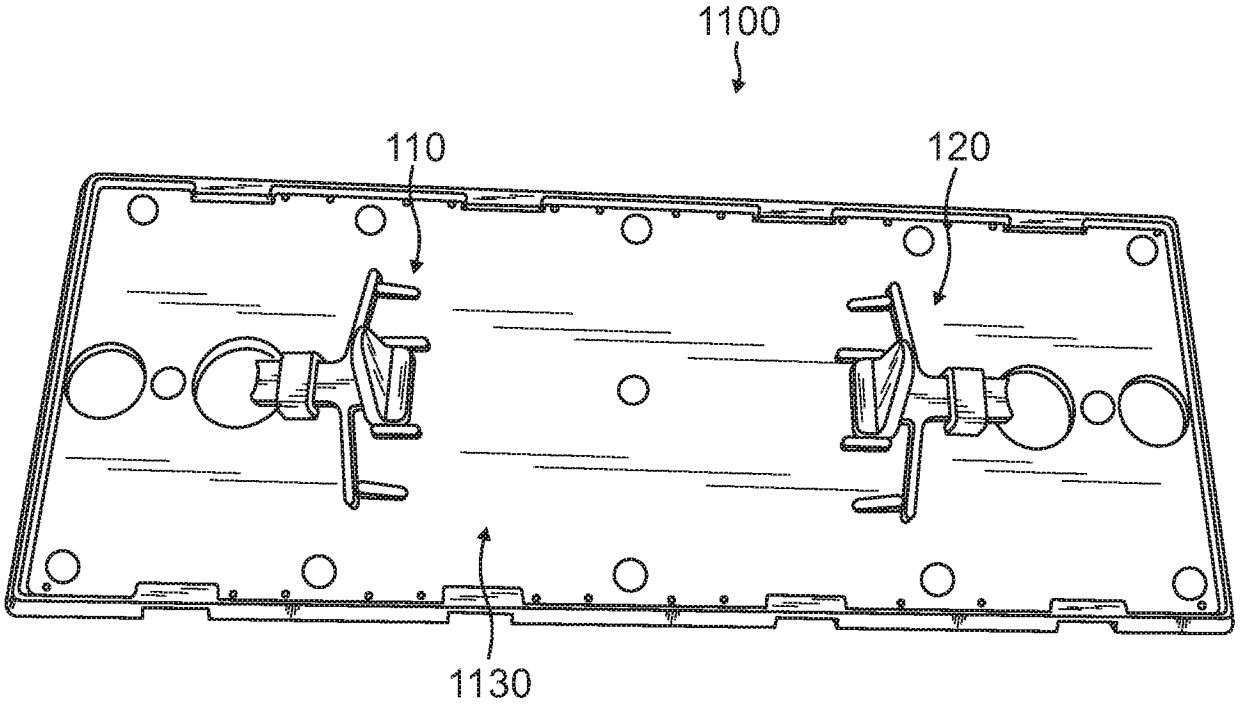
FIG. 9A is a top perspective view of the second embodiment of the mechanical plate in the un-activated condition.
Figure 9B:
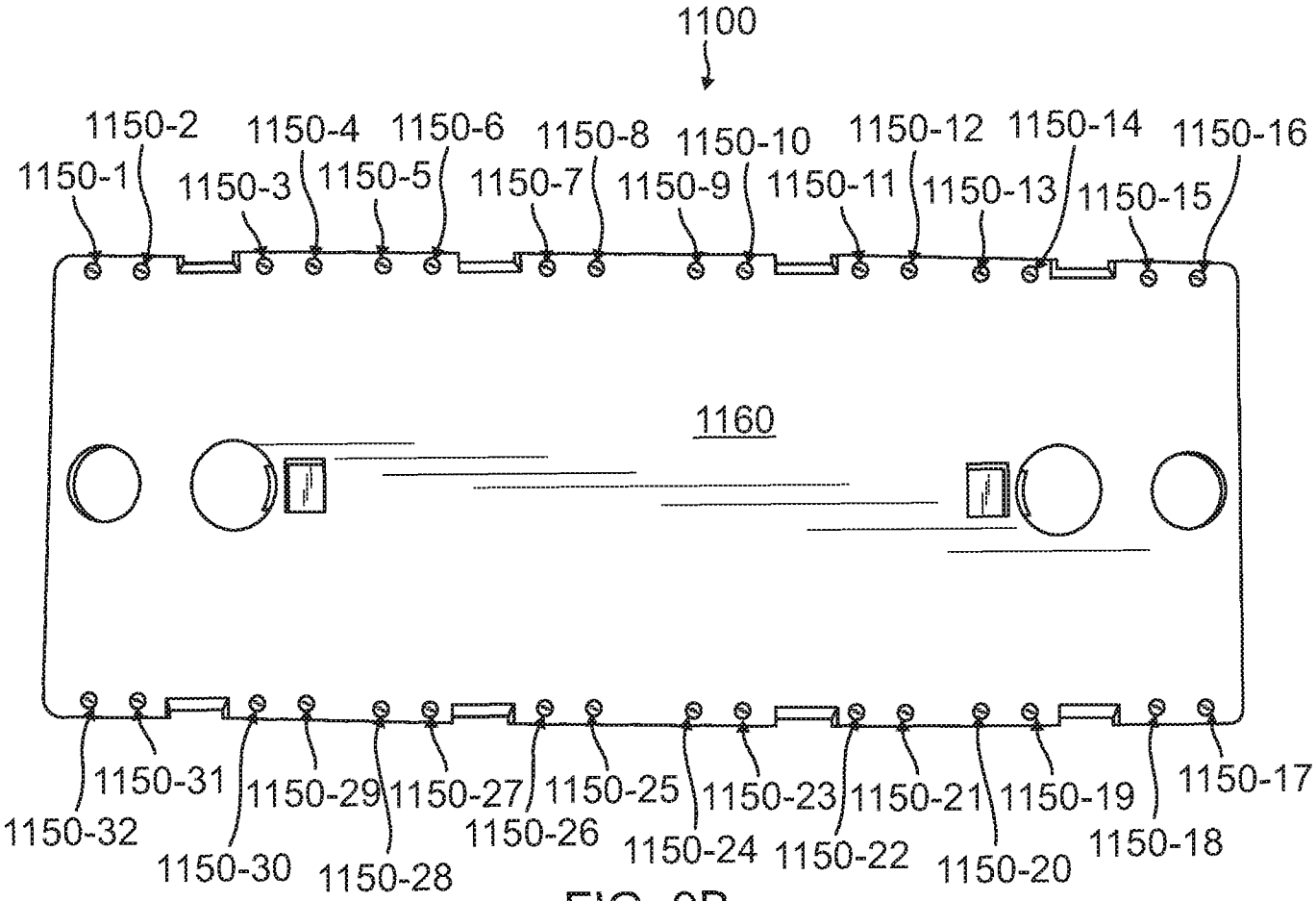
FIG. 9B is a bottom perspective view of the second embodiment of the mechanical plate.
Figure 10A:
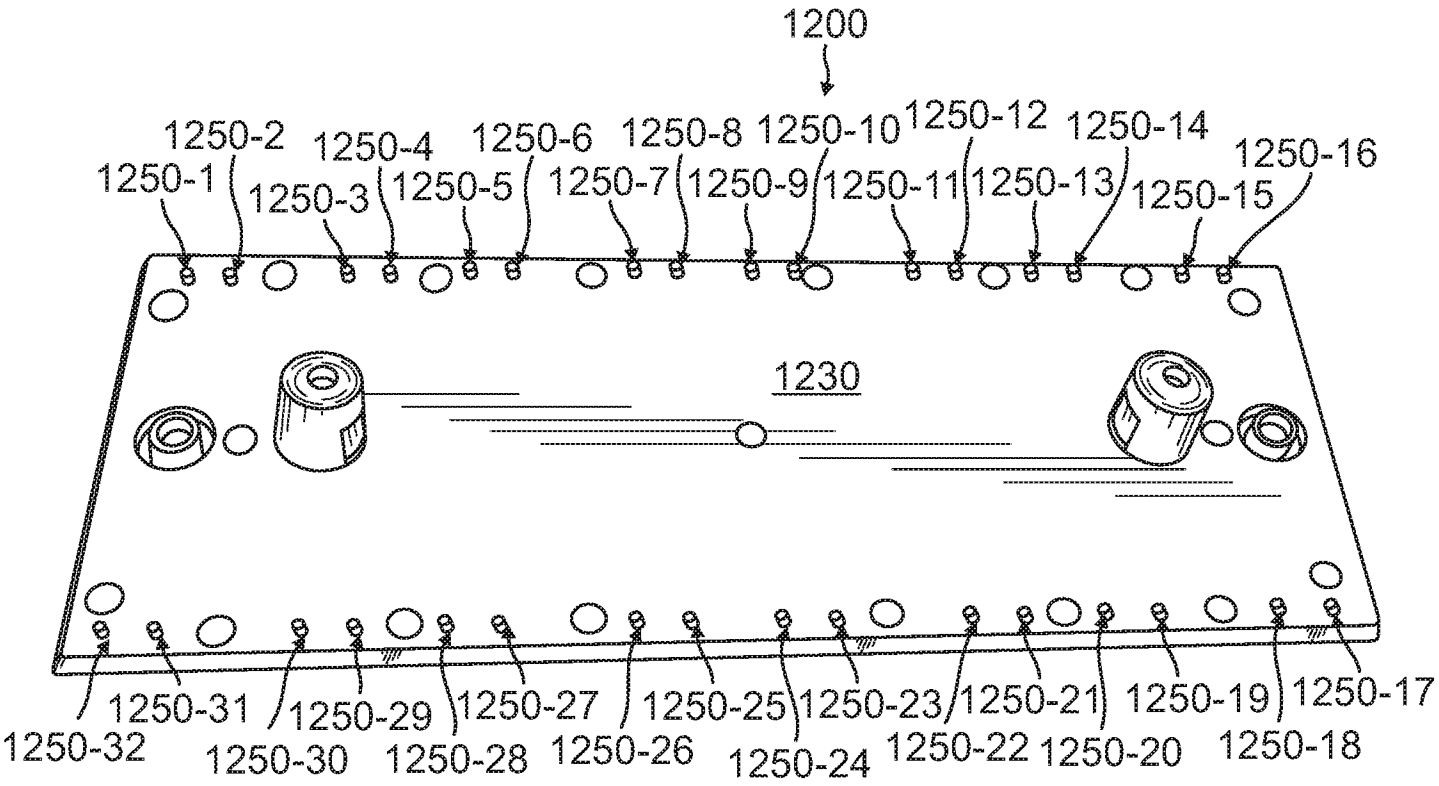
FIG. 10A is a top perspective view of the second embodiment of the push plate.

Therefore, referring to FIGS. 9A, 9B and 10A, there is illustrated a second embodiment mechanical plate 1100 having a top mechanical surface 1130 and a bottom mechanical surface 1160. Second embodiment mechanical plate 1100 has a Bottom mechanical surface 1160 having 32 female mating members identified as 1150-1, 1150-2, 1150-3, 1150-4, 1150-5, 1150-6, 1150-7, 1150-8, 1150-9, 1150-10, 1150-11, 1150-12, 1150-13, 1150-14, 1150-15 1150-16, 1150-17, 1150-18, 1150-19, 1150-20, 1150-21, 1150-22, 1150-23, 1150-24, 115-25, 1150-26, 1150-27, 1150-28, 1150-29, 1150-30, 1150-31 and 1150-32. Female mating members 1150-1 through 1150-32 mate with push plate male mating members (or teeth) 1250-1, 1250-2, 1250-3, 1250-4, 1250-5, 1250-6, 1250-7, 1250-8, 1250-9, 1250-10, 1250-11, 1250-12, 1250-13, 1250-14, 1250-15, 1250-16, 1250-17, 1250-18, 1250-19, 1250-20, 1250-21, 1250-22, 1250-23, 1250-24, 1250-25, 1250-26, 1250-27, 1250-28, 1250-29, 1250-30, 1250-31 and 1250-32 to retain cloth 1400 in between second embodiment r push plate 1200 and second embodiment mechanical plate 1100.

Figure 10B:
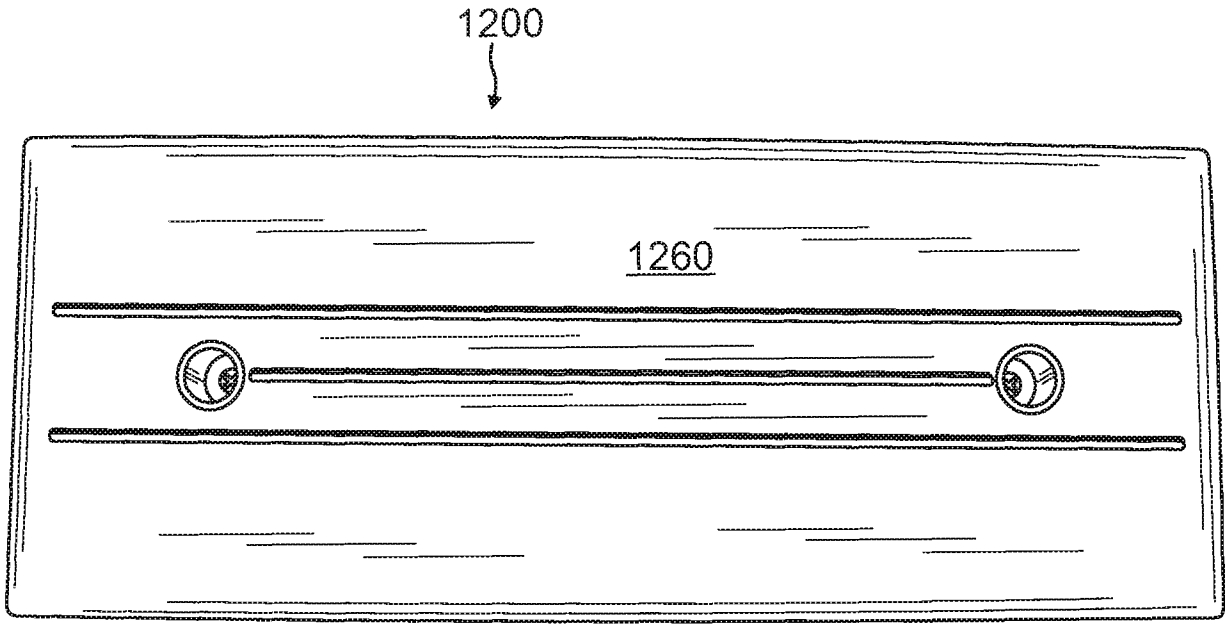
FIG. 10B is a bottom perspective view of the second embodiment of the push plate.
Figure 11A:
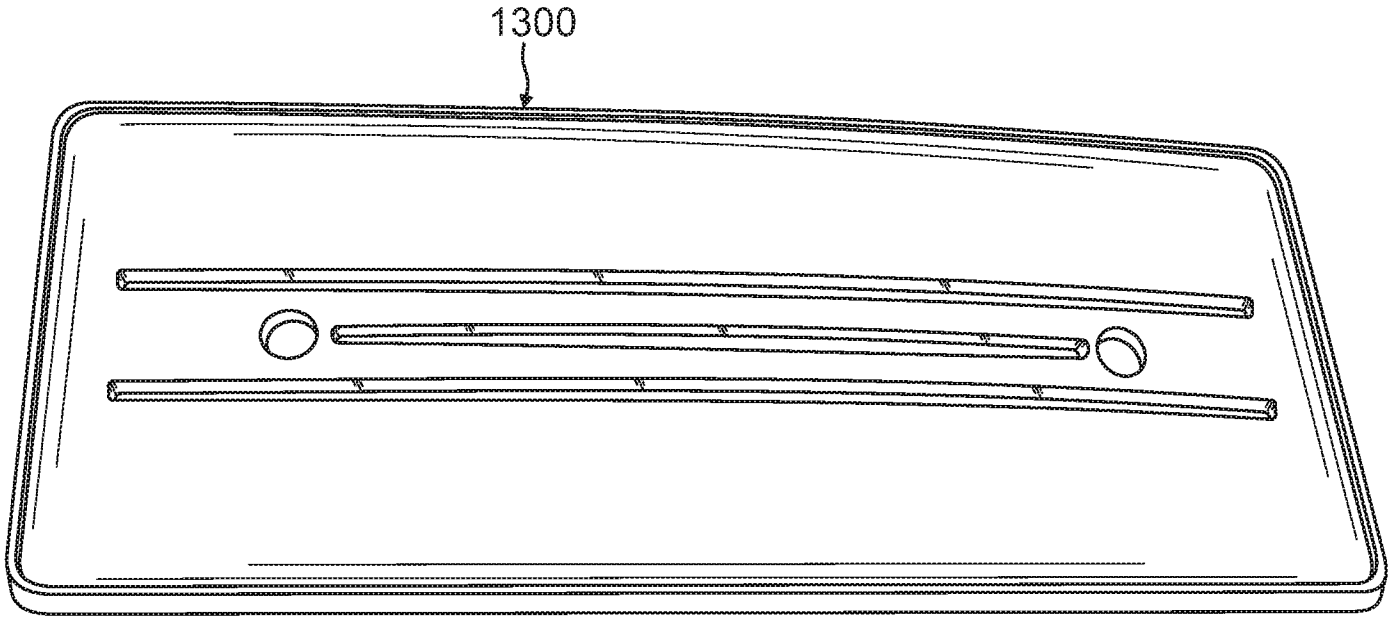
FIG. 11A is a top perspective view of a pad used with the second embodiment of the push plate.
Figure 11B:
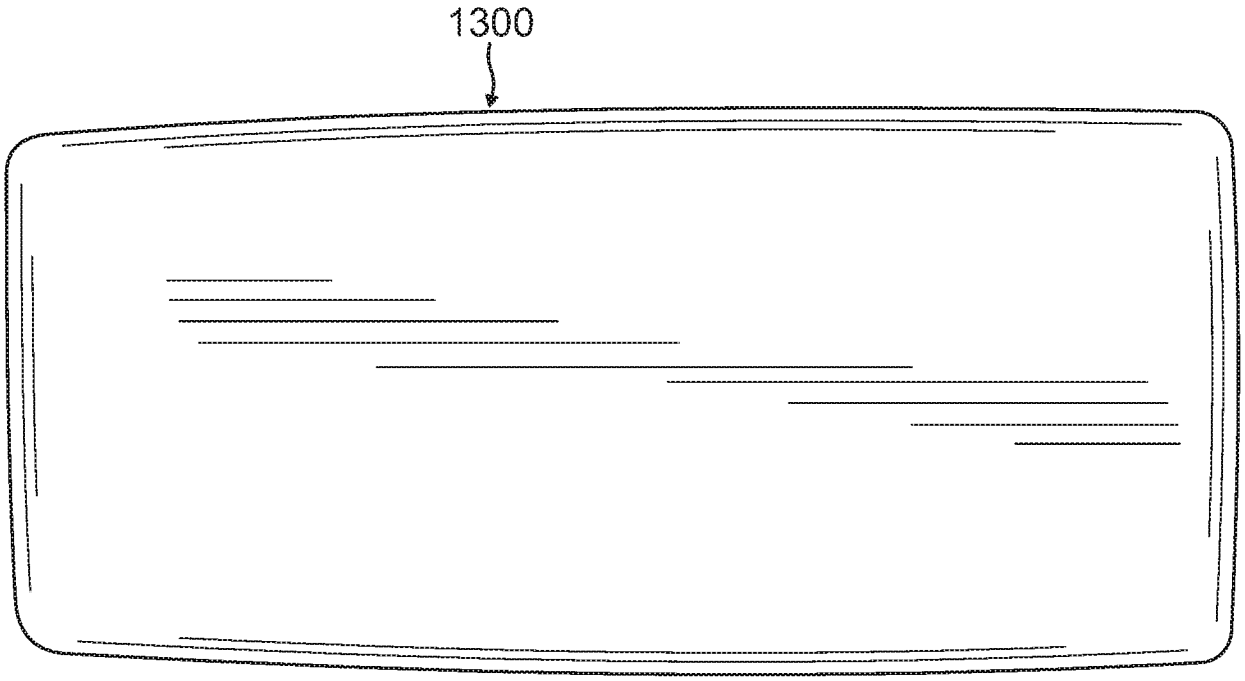
FIG. 11B is a bottom perspective view of the rubber pad used with the second embodiment of the push plate.

As previously stated, all the other elements within the first embodiment besides the method by which the non-woven cloth 1400 is retained remain the same between the first embodiment and the second embodiment. For completeness, FIG. 10B illustrating a bottom view of second embodiment push plate 1200 having a second embodiment push plate bottom surface 1260 is illustrated. Similarly, FIGS. 11A and 11B illustrate second embodiment pad 1300.

Figures 1, 12:
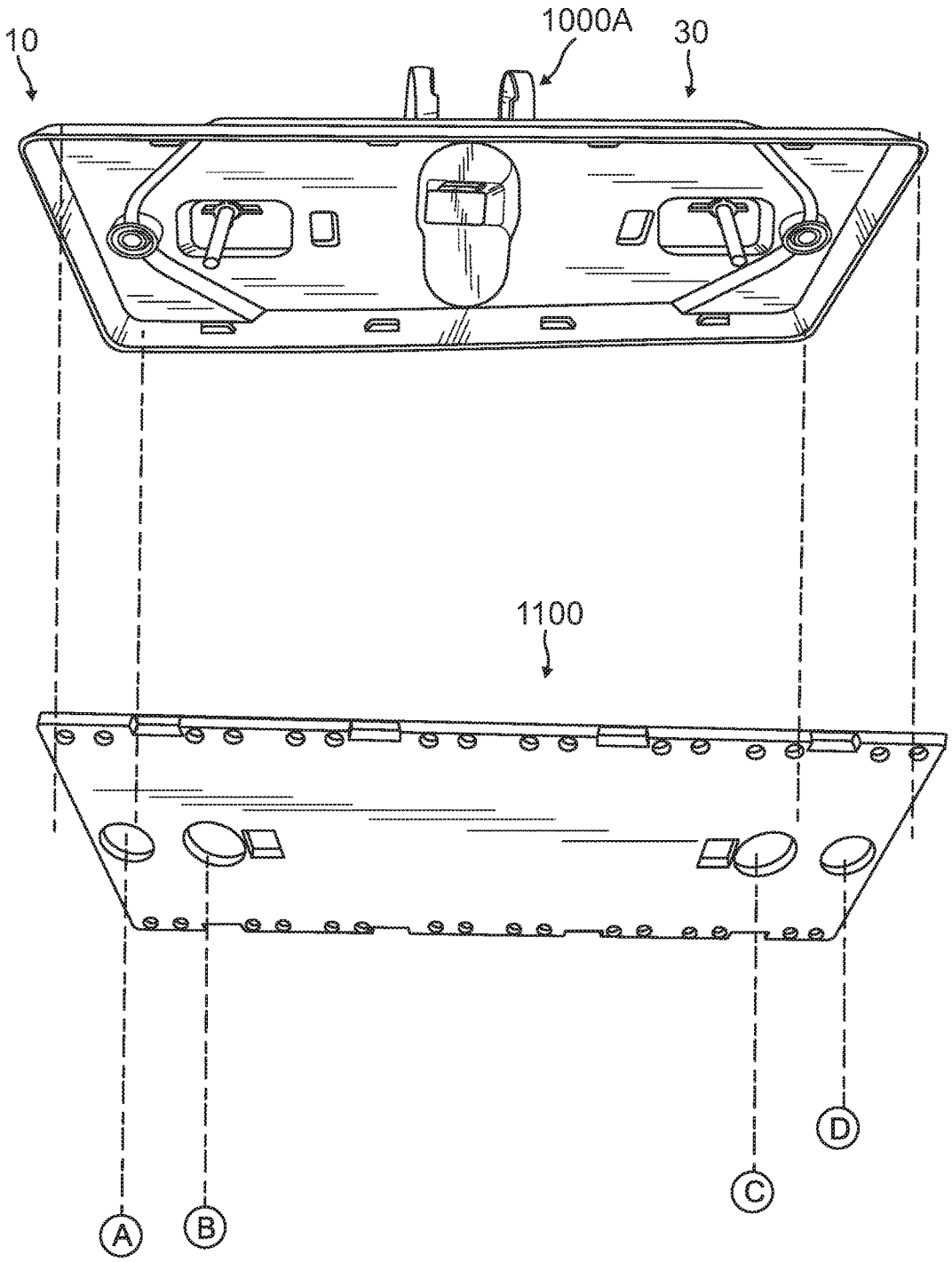
Figures 2, 12:
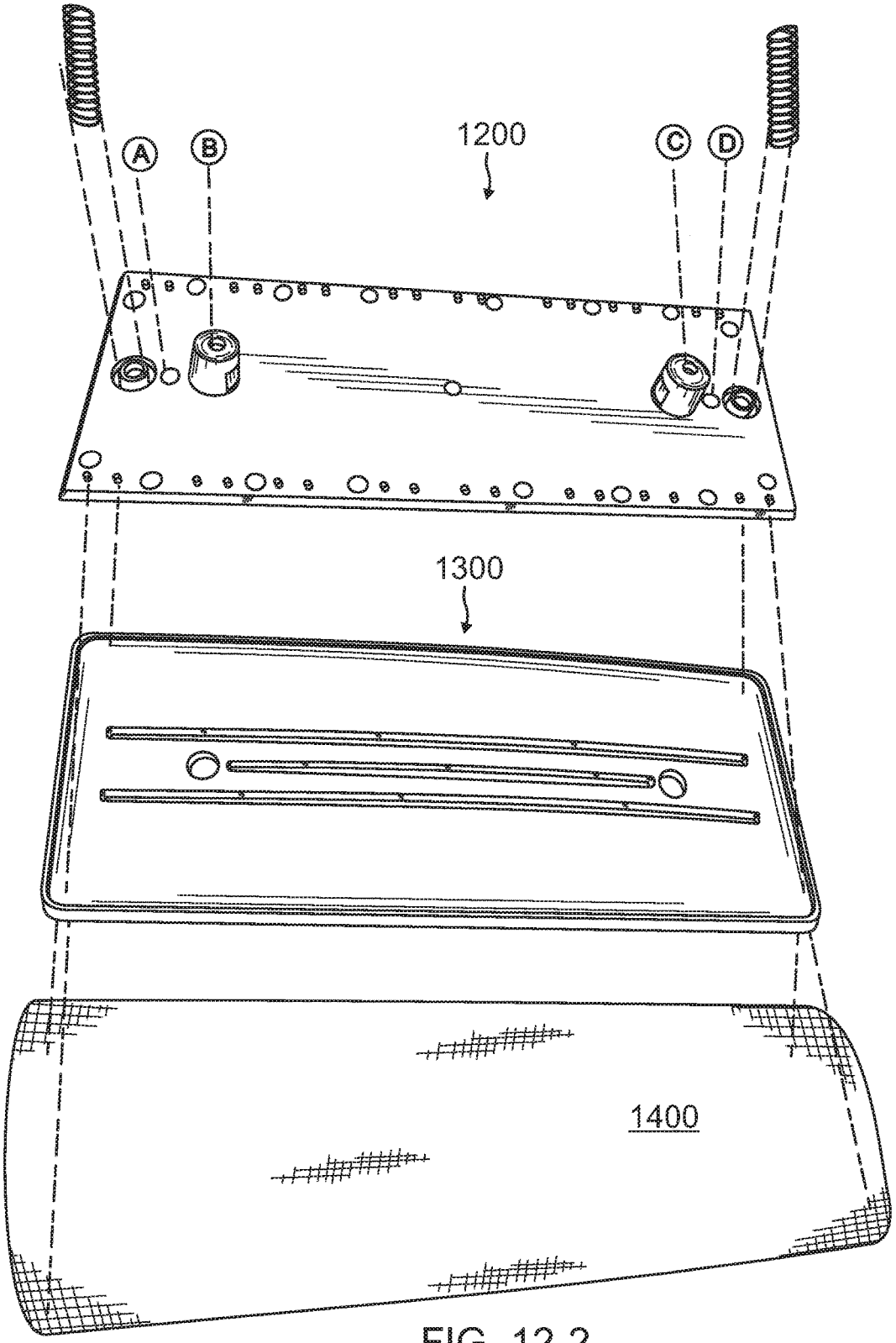

Referring to FIG. 12, there is illustrated an exploded view of the second embodiment present invention flat mop with yoke retaining member and dual trigger 10A. The second embodiment includes the same top cover 30, second embodiment mechanical plate 1100, second embodiment push plate 1200 and second embodiment pad (made material such as rubber or foam) 1300.

Figure 13:
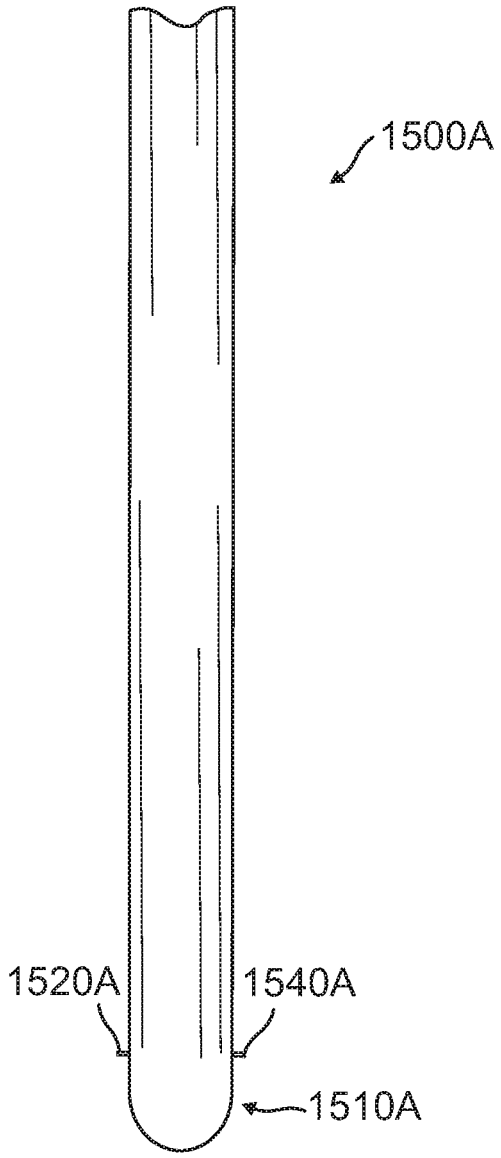
FIG. 13 is a side elevational view of a portion of the mop handle illustrating the pin by which the mop handle is rotatably retained to the yoke.

FIG. 13 is a side elevational view of portion of the handle used with the alternative embodiment of the present invention which in effect is the same as the handle used with the first embodiment. Therefore, the parts are numbered correspondingly with the letter "A" after it. Therefore, the mop handle is numbered 1500A, the bottom of the mop handle is numbered 1510A and the pins that are inserted into the "U"-shaped retainers of the yoke are 1520A and 1540A.

Figure 14:
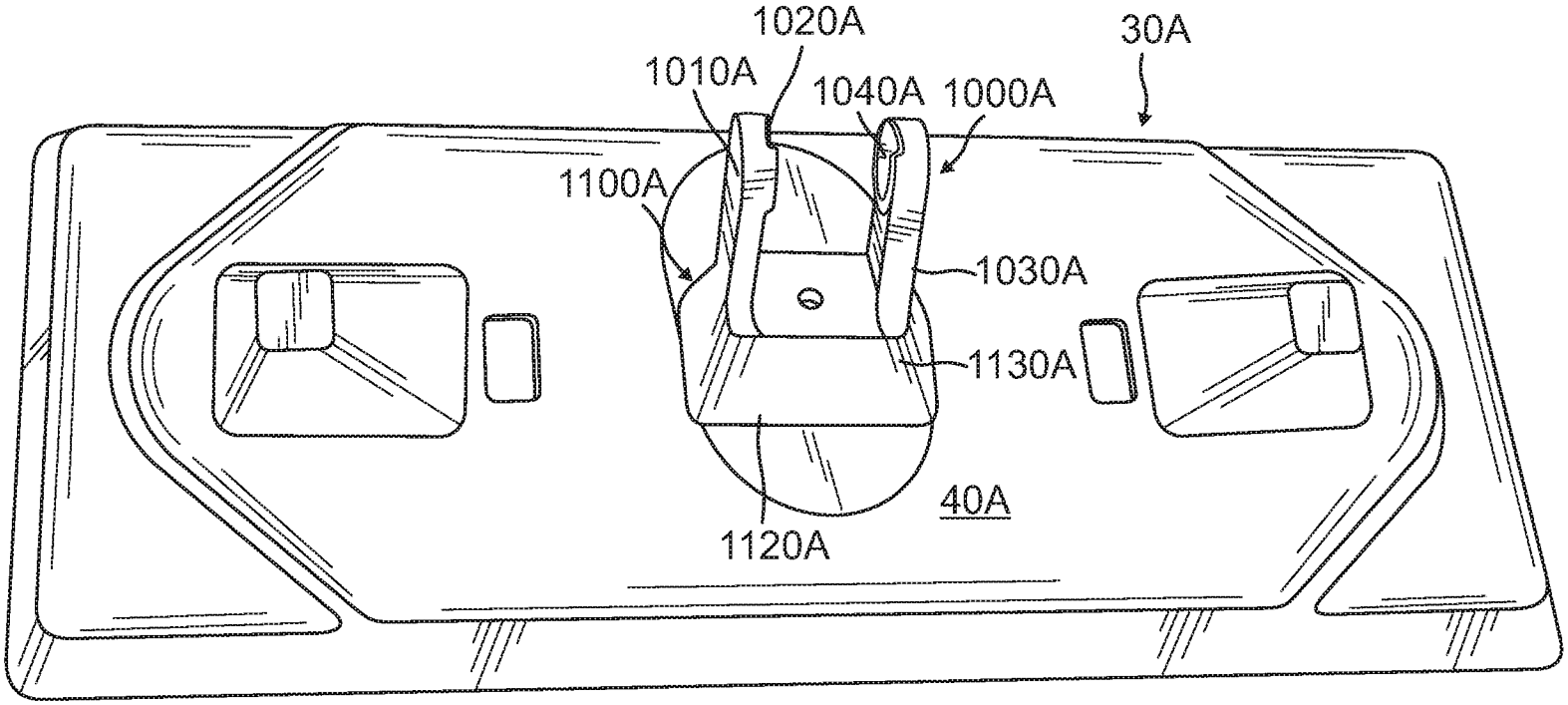
FIG. 14 is a top perspective view of the top plate of the alternative embodiment of the present invention with the yoke affixed to the top plate and centrally located on the top plate and with the handle removed to illustrate the mechanism of the yoke to rotatably retain the handle.

FIG. 14 discloses the yoke used with the alternative embodiment of the present embodiment of the present invention which in effect is the same as the yoke used with the first embodiment of the present invention. However, because it is being described as used with the alternative embodiment, the letter "A" has been added after each corresponding part. The flat mop is numbered 10A with the yoke 1000A including base 1100A having a lower portion 1120A affixed to the top plate 30A. The yoke 1000 includes an upper portion 1130A which supports a first transverse post 1010A with a "U"-shaped retaining section 1020A and a second parallel spaced apart post 1030A with a "U"-shaped retaining section 1040A. The "U"-shaped retaining sections 1020A and 1040A are parallel to each other. Referring back to FIG. 13, the mop handle 1500A has a bottom end 1510A and a pair of retaining members 1520A and 1540A which are retained in the respective retaining sections 1020A and 1040A of the yoke 1000A.

Figure 15:
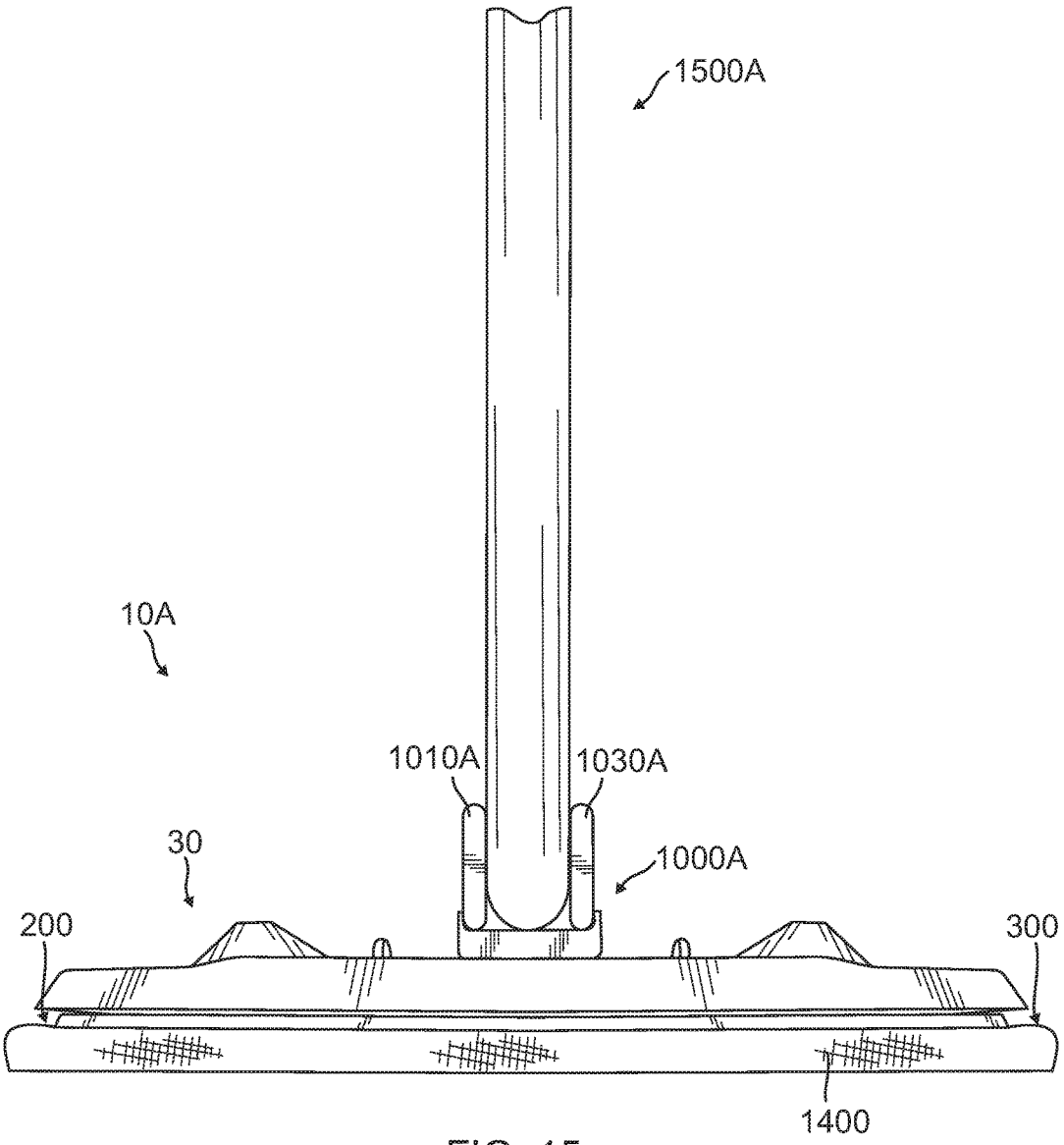
FIG. 15 is a top-side view of the second embodiment of the present invention 10A in to un-activated condition.
Figure 16:
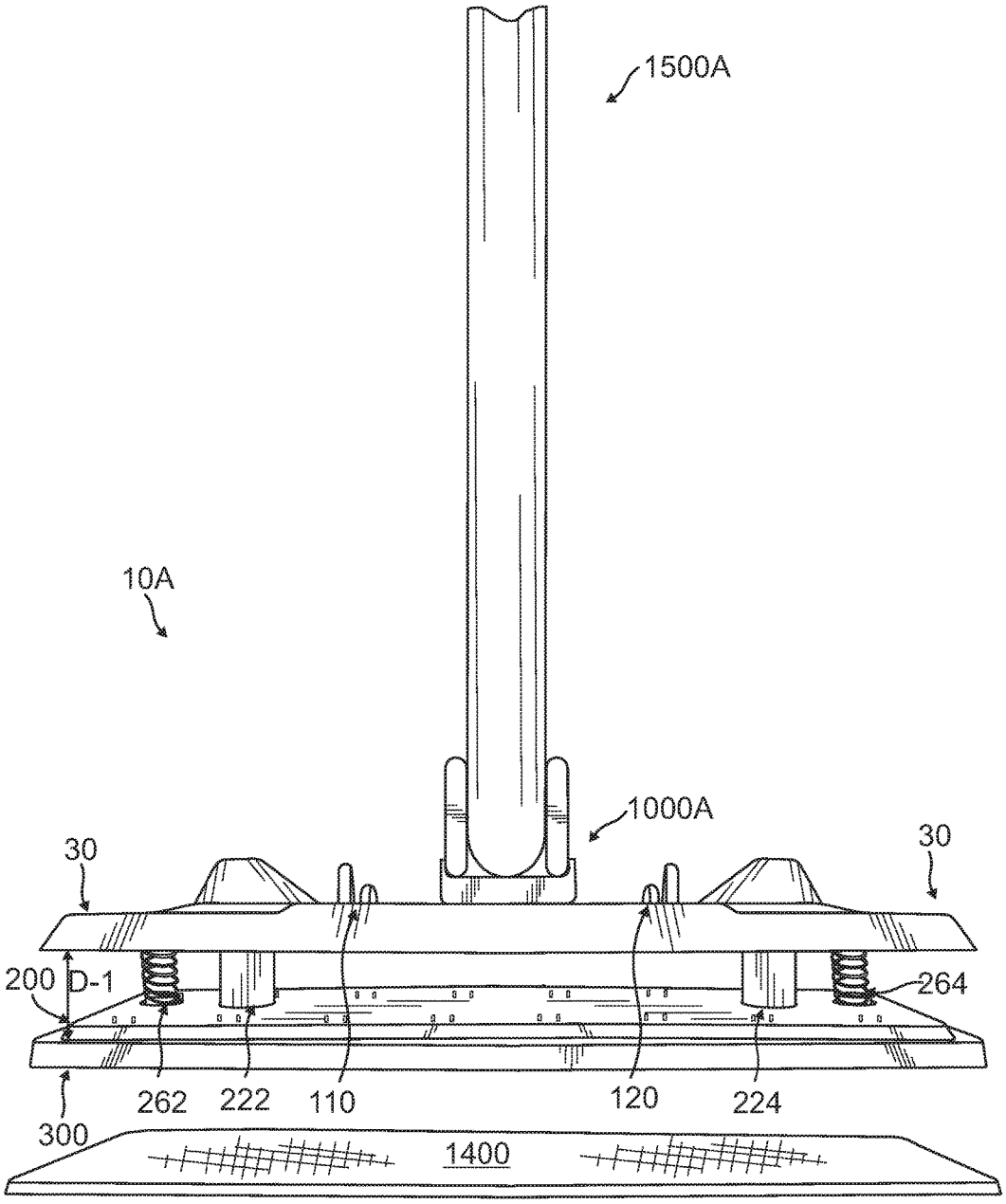
FIG. 16 is an exploded top-side perspective view of the second embodiment of the present invention 10A in the activated condition.

Referring to FIG. 15, there is illustrated to top side perspective view of the second embodiment of the present invention 10A in the un-activated condition. Referring to FIG. 16 there is illustrated to top-side perspective view of the second embodiment of the present invention 10A in the activated condition. The corresponding parts for the new yoke 1000A and handle 1500A are marked in FIGS. 15 and 16, portions of the numbers being marked, reference being had for FIGS. 13 and 14 for a more detailed description of the handle and the yoke. It is emphasized that the handle and the yoke are the same for the second embodiment as of the first embodiment but have been numbered with an "A" to distinguish the handle and yoke of the second embodiment from the first embodiment.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mop comprising:

a. a yoke including a base having a lower portion affixed to a flat top surface of a stationery top portion of a top plate, the yoke located at a longitudinal lengthwise center and widthwise center of the flat top surface of the top plate, the yoke including an upper portion which supports a first transverse post with a "U"-shaped retaining section and a second parallel spaced apart transverse post with a "U"-shaped retaining section, the "U"-shaped retaining sections being parallel;

b. a handle having a bottom section which includes a first extension member which is rotatably retained in said "U"-shaped retaining section of said first transverse post and the handle having a second extension member rotatably retained in said "U"-shaped retaining section of said second spaced apart transverse post to enable rotation of said handle in an arc transverse to the top plate;

c. the top plate also including spaced apart trigger activation member openings spaced at equidistant opposite sides of the yoke and extending through a thickness of the top portion of the top plate, a first trigger activation member extends through a first activation member opening and a second trigger activation member extends through a second trigger activation member opening, each trigger activation member extending perpendicular to the flat upper surface of the top plate, the first and second trigger activation members are parallel to each other, each respective trigger activation member opening is sufficiently wide to enable each respective trigger activation member to be pushed toward the centrally located yoke, the top plate also includes a first ratchet collar cover located on the same side as and spaced apart from the first trigger activation member opening and closer to a first end of the top plate, the top plate also including a second ratchet collar cover located on the same side as and spaced apart from the second trigger activation member opening and closer to a second end of the top plate, each respective ratchet collar cover is respectively spaced apart from a respective trigger activation member opening and each ratchet collar cover is further away from the centrally located yoke;

d. the top plate having a bottom surface which includes a first compression spring housing supporting a top of a first compression spring and a second compression spring housing supporting a top of a second compression spring;

e. a mechanical plate retained onto a bottom portion of the top plate by mating notch members on the longitudinal sidewalls of the mechanical plate and tooth members along bottom longitudinal walls of the top plate;

f. the mechanical plate including a first trigger member having a first "L"-shaped member with an upper portion extending through the first trigger activation member opening in the top plate with the upper portion of the first "L"-shaped member extending perpendicular to the top plate, a horizontal portion of the first "L"-shaped member extending to engage a first transverse trigger member spring member is further aligned with a first stop member on the top surface of the mechanical plate and at its distal end forms a first notch tooth, a second trigger member having a second "L"-shaped member with an upper portion extending through the second trigger activation member opening in the top plate with an upper portion of the second "L"-shaped member extending perpendicular to the top plate, a horizontal portion of the second "L"-shaped member extending to engage a second transverse trigger member spring member is further aligned with a second stop member on the top surface of the mechanical plate and at its distal end forms a second notch tooth;

g. the mechanical plate including a first ratchet collar opening adjacent said first tooth, a second ratchet collar opening adjacent said second tooth, a first compression spring opening and a second compression spring opening;

h. a push plate having a top surface including a first ratchet collar vertically aligned with the first ratchet collar cover of the top plate and spaced apart from a first operating trigger assembly of the first trigger member on the mechanical plate, the first ratchet collar having a sidewall with a first ratchet notch which receives the first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from a second operating trigger assembly of the second trigger member on the mechanical plate, the second ratchet collar has a sidewall with a second ratchet notch which receives the second notch tooth from the second trigger member, the second ratchet collar extends through aligned openings in the mechanical plate and the top plate and is received in the second ratchet collar cover on the top plate;

i. affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate;

j. a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar;

k. the first compression spring retained at its bottom end in the first compression spring housing in the push plate, the first compression spring extending through the first compression spring opening in the mechanical plate and retained at its top end in the first compression spring housing in the top plate, the second compression spring retained at its bottom end in the second compression spring housing in the push plate, the second compression spring extending through the second compression spring opening in the mechanical plate and retained at its top end in the second compression spring housing in the top plate;

l. a pad retained onto a bottom surface of the push plate;

m. a cloth removably retained under a bottom surface of said pad, the cloth retained by retaining members from at least the mechanical plate; and n. wherein in an un-activated condition, the first tooth is retained in the first notch in the first ratchet collar, the second tooth is retained in the second notch in the second ratchet collar, the first and second compression springs are compressed and the cloth is removably retained, and when the first tooth is removed from the first notch and the second tooth is removed from the second notch, the first and second compression springs are converted to an un-compressed state and force the retaining members away from the cloth which falls away, the push plate travels away from the mechanical plate by a length of the shaft of the respective first and second mechanical fastening members.

2. The mop in accordance with claim 1, further comprising:

said pad is made of material selected from the group consisting of rubber and foam.

3. The mop in accordance with claim 1, further comprising:

a. a multiplicity of spaced apart cloth retaining members respectively affixed to and extending away from a bottom surface of said mechanical plate;

b. a respective hook fastener at a distal end of each respective one of said multiplicity of spaced apart cloth retaining members;

c. said push plate including a multiplicity of spaced apart openings extending from an upper surface to a lower surface of the push plate, each one of said multiplicity of spaced apart openings aligned with a respective one of said multiplicity of cloth retaining members to enable a respective one of said multiplicity of cloth retaining members to extend through said push plate;

d. said pad including a multiplicity of spaced apart openings extending from an upper surface to a lower surface of the pad, each one of said multiplicity of spaced apart openings aligned with a respective one of said multiplicity of cloth retaining members to enable a respective one of said multiplicity of cloth retaining members to extend through said pad; and e. wherein said cloth is a microfiber cloth retained by said respective hook fasteners at a respective distal end of each of said cloth retaining members;

f. whereby, when said trigger activation members are in the un-activated condition, the microfiber cloth is retained against a lower surface of said pad, and when said trigger activation members are in an activated condition, the hook fasteners are released from the retention off the microfiber cloth and the microfiber cloth falls away without being touched.

4. The mop in accordance with claim 1, further comprising:

a. a bottom of said mechanical plate including a multiplicity of spaced apart aligned openings extending adjacent each respective longitudinal side of the bottom of the mechanical plate;

b. said push plate including a multiplicity of spaced apart teeth extending perpendicular to the upper surface of the push plate and extending adjacent each longitudinal side of the top surface of the push plate, a respective one of the multiplicity of spaced apart teeth respectively aligned with and engaged into a respective one of the spaced apart openings in the mechanical plate so that said mechanical plate is affixed to said top plate; and c. wherein said cloth is a non-woven cloth retained adjacent the bottom surface of the pad and wrapped around the push plate and press fit retained between the multiplicity of teeth on the push plate and aligned openings on the mechanical plate;

d. whereby, when said trigger activation members are in the un-activated condition, the non-woven cloth is press fit retained between the mechanical plate and the push plate, and when said trigger activation members are in an activated condition, the mechanical plate and the push plate are separated and the press fit retention between the teeth on the push plate and aligned openings in the mechanical plate is released and the non-woven cloth falls away without being touched.

5. A mop comprising:

a. a handle rotatably retained by a yoke which is affixed at a central location on an upper surface of a top plate;

b. the top plate also including a first trigger activation member opening and a second trigger activation member opening which are spaced at equidistant opposite sides of the yoke and each extending through a thickness of a top portion of the top plate, the top plate also includes a first ratchet collar cover located on the same side as and spaced apart from the first trigger activation member opening and a second ratchet collar cover located on the same side as and spaced apart from the second trigger activation member opening;

c. the top plate having a bottom surface which includes a first compression spring housing supporting a top of a first compression spring and a second compression spring housing supporting a top of a second compression spring;

d. a mechanical plate retained onto a bottom portion of the top plate by mating members on the bottom portion of the top plate affixed to mating members on an upper surface of the mechanical plate;

e. the mechanical plate including a first trigger activation member having a first "L"-shaped member with an upper portion extending through the first trigger activation member opening in the top plate with the upper portion of the first "L"-shaped member extending perpendicular to the top plate, a horizontal portion of the first "L"-shaped member extending to engaging a first transverse trigger member spring member and is further aligned with a first stop member on the top surface of the mechanical plate and at its distal end forms a first notch tooth, a second trigger activation member having a second "L"-shaped member with an upper portion extending through the second trigger activation member opening in the top plate and extending perpendicular to the top plate, a horizontal portion of the second "L"-shaped member extending to engage a second transverse trigger member spring member and is further aligned with a second stop member on the top surface of the mechanical plate and at its distal end forms a second notch tooth, the first notch tooth and the second notch tooth spaced apart and facing away from each other;

f. the mechanical plate including a first ratchet collar opening adjacent said first notch tooth, a second ratchet collar opening adjacent said second notch tooth, a first compression spring opening and a second compression spring opening;

g. a push plate having a top surface including a first ratchet collar vertically aligned with the first ratchet collar cover of the top plate and spaced apart from a first operating trigger assembly of the first trigger member on the mechanical plate, the first ratchet collar having a sidewall with a first ratchet notch which receives the first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from a second operating trigger assembly of the second trigger member on the mechanical plate, the second ratchet collar having a sidewall with a second ratchet notch which receives the second notch tooth from the second trigger member, the second ratchet collar extends through aligned openings in the mechanical plate and the top plate and is received in the second ratchet collar cover on the top plate;

h. affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate;

i. a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar;

j. a cloth removably retained under a bottom surface of said push plate, the cloth retained by retaining members from at least the mechanical plate; and k. wherein in an un-activated condition, the first tooth is retained in the first notch in the first ratchet collar, the second tooth is retained in the second notch in the second ratchet collar, the first and second compression springs are compressed and the cloth is removably retained by the retaining members, and when the upper portion of the first L-shaped trigger activation member is pushed toward the yoke and simultaneously the upper portion of the second "L"-shaped trigger activation member is pushed toward the yoke, then the first tooth is removed from the first notch and the second tooth is removed from the second notch, the first and second compression springs are converted to an uncompressed state and force the retaining members away from the cloth which falls away, the push plate travels away from the mechanical plate by a length of the shaft of the respective first and second mechanical fastening members.

6. The mop in accordance with claim 5, further comprising:

a. a multiplicity of spaced apart cloth retaining members respectively affixed to and extending away from a bottom surface of said mechanical plate;

b. a respective hook fastener at a distal end of each respective one of said multiplicity of spaced apart cloth retaining members;

c. said push plate including a multiplicity of spaced apart openings extending from an upper surface to a lower surface of the push plate, each one of said multiplicity of spaced apart openings aligned with a respective one of said multiplicity of cloth retaining members to enable a respective one of said multiplicity of cloth retaining members to extend through said push plate; and d. wherein said cloth is a microfiber cloth retained by said respective hook fasteners at a respective distal end of each of said cloth retaining members;

e. whereby, when said trigger activation members are in the un-activated condition, the microfiber cloth is retained against a lower surface of said push plate, and when said trigger activation members are in an activated condition, the hook fasteners are released from the retention of the microfiber cloth and the microfiber cloth falls away without being touched.

7. The mop in accordance with claim 6, further comprising:

a. a pad affixed to a lower surface of the push plate;

b. said pad including a multiplicity of spaced apart openings extending from an upper surface to a lower surface of the pad, each one of said multiplicity of spaced apart openings aligned with a respective one of said multiplicity of cloth retaining members to enable a respective one of said multiplicity of cloth retaining members to extend through said pad and retain said cloth both under said push plate and under said pad.

8. The mop in accordance with claim 5, further comprising:

a. a bottom of said mechanical plate including a multiplicity of spaced apart aligned openings extending adjacent each respective longitudinal side of the bottom of the mechanical plate;

b. said push plate including a multiplicity of spaced apart teeth extending perpendicular to the upper surface of the push plate and extending adjacent each longitudinal side of the top surface of the push plate, a respective one of the multiplicity of spaced apart teeth respectively aligned with and engaged into a respective one of the spaced apart openings in the mechanical plate so that said mechanical plate is affixed to said top plate; and c. wherein said cloth is a non-woven cloth retained adjacent the bottom surface of the push plate and wrapped around the push plate and press fit retained between the multiplicity of teeth on the push plate and aligned openings on the mechanical plate;

d. whereby, when said trigger activation members are in the un-activated condition, the non-woven cloth is press fit retained between the mechanical plate and the push plate, and when said trigger activation member is in the activated condition, the mechanical plate and the push plate are separated and the press fit retention between the teeth on the push plate and aligned openings on the mechanical plate is released and the non-woven cloth falls away without being touched.

9. The mop in accordance with claim 8, further comprising: a pad is affixed to the lower surface of the push plate and the non-woven cloth is retained against said pad.

10. A mop comprising:

a. a handle rotatably retained by a yoke which is affixed at a central location on an upper surface of a top plate;

b. a mechanical plate affixed onto said top plate, the mechanical plate including a first trigger member having a first "L"-shaped member with an upper portion extending through the top plate and a horizontal portion terminating in a first tooth, a second trigger member having a second "L"-shaped member with an upper portion extending through the top plate and a horizontal portion terminating in a second tooth, the respective upper portions of the first and second trigger member located on opposite sides of said yoke and spaced apart from the yoke with openings in the top plate to enable the respective upper portions of the first and second trigger members to move toward each other, the horizontal portions of the first and second trigger members facing away from each other;

c. a push plate having a top surface including a first ratchet collar vertically aligned with an opening in the mechanical plate adjacent said first tooth, a notch in the first ratchet collar into which the first tooth is inserted under spring pressure, a second ratchet collar vertically aligned with an opening in the mechanical plate adjacent said second tooth, a notch in the second ratchet collar into which the second tooth is inserted under spring pressure;

d. at least one compression spring retained at a top end in the top plate and at a bottom end retained in the push plate, the at least one compression spring extending through an aligned opening in the mechanical plate;

e. a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar;

f. a cloth removably retained under a bottom surface of said push plate, the cloth retained by retaining members from at least the mechanical plate; and g. wherein in an un-activated condition, the first tooth is retained in the first notch in the first ratchet collar, the second tooth is retained in the second notch in the second ratchet collar, the at least one compression spring is compressed and the cloth is removably retained by the retaining members, and when the upper portion of the first "L"-shaped trigger member is pushed toward the yoke and simultaneously the upper portion of the second "L"-shaped trigger member is pushed toward the yoke, then the first tooth is removed from the first notch and the second tooth is removed from the second notch, the at least one compression spring is converted to an un-compressed state and force the retaining members away from the cloth which falls away, the push plate travels away from the mechanical plate by a length of the shaft of the respective first and second mechanical fastening members.

11. The mop in accordance with claim 10, further comprising:

a. a multiplicity of spaced apart cloth retaining members respectively affixed to and extending away from a bottom surface of said mechanical plate;

b. a respective hook fastener at a distal end of each respective one of said multiplicity of spaced apart cloth retaining members;

c. said push plate including a multiplicity of spaced apart openings extending from an upper surface to a lower surface of the push plate, each one of said multiplicity of spaced apart openings aligned with a respective one of said multiplicity of cloth retaining members to enable a respective one of said multiplicity of cloth retaining members to extend through said push plate; and d. wherein said cloth is a microfiber cloth retained by said respective hook fasteners at a respective distal end of each of said cloth retaining members;

e. whereby, when said trigger members are in the unactivated condition, the microfiber cloth is retained against a lower surface of said push plate, and when said trigger members are in an activated condition, the hook fasteners are released from the retention of the microfiber cloth and the microfiber cloth falls away without being touched.

12. The mop in accordance with claim 10, further comprising:

a. a bottom of said mechanical plate including a multiplicity of spaced apart aligned openings extending adjacent each respective longitudinal side of the bottom of the mechanical plate;

b. said push plate including a multiplicity of spaced apart teeth extending perpendicular to the upper surface of the push plate and extending adjacent each longitudinal side of the top surface of the push plate, a respective one of the multiplicity of spaced apart teeth respectively aligned with and engaged into a respective one of the spaced apart openings in the mechanical plate so that said mechanical plate is affixed to said top plate; and c. wherein said cloth is a non-woven cloth retained adjacent the bottom surface of the push plate and wrapped around the push plate and press fit retained between the multiplicity of teeth on the push plate and aligned openings on the mechanical plate;

d. whereby, when said trigger members are in the unactivated condition, the non-woven cloth is press fit retained between the mechanical plate and the push plate, and when said trigger members are in an activated condition, the mechanical plate and the push plate are separated and the press fit retention between the teeth on the push plate and aligned openings on the mechanical plate is released and the non-woven cloth falls away without being touched.

* * * * *